US010280937B2

(12) United States Patent
Nonaka et al.

(10) Patent No.: US 10,280,937 B2
(45) Date of Patent: May 7, 2019

(54) VACUUM PUMP COMPONENT, SIEGBAHN TYPE EXHAUST MECHANISM AND COMPOUND VACUUM PUMP

(71) Applicant: Edwards Japan Limited, Yachiyo-shi, Chiba (JP)

(72) Inventors: Manabu Nonaka, Yachiyo (JP); Takashi Kabasawa, Yachiyo (JP)

(73) Assignee: Edwards Japan Limited, Chiba (JP)

( * ) Notice: Subject to any disclaimer, the term of this patent is extended or adjusted under 35 U.S.C. 154(b) by 406 days.

(21) Appl. No.: 15/037,545

(22) PCT Filed: Oct. 3, 2014

(86) PCT No.: PCT/JP2014/076499

§ 371 (c)(1),
(2) Date: May 18, 2016

(87) PCT Pub. No.: WO2015/079801

PCT Pub. Date: Jun. 4, 2015

(65) Prior Publication Data

US 2016/0298645 A1 Oct. 13, 2016

(30) Foreign Application Priority Data

Nov. 28, 2013 (JP) ..... 2013-245684

(51) Int. Cl.
*F04D 29/44* (2006.01)
*F04D 17/12* (2006.01)
(Continued)

(52) U.S. Cl.
CPC ..... *F04D 29/441* (2013.01); *F04D 17/122* (2013.01); *F04D 17/168* (2013.01);
(Continued)

(58) Field of Classification Search
CPC ..... F04D 17/12; F04D 17/122; F04D 17/168; F04D 29/441; F05D 2240/12
See application file for complete search history.

(56) References Cited

U.S. PATENT DOCUMENTS 5,695,316 A 12/1997 Schutz et al.
7,717,684 B2 * 5/2010 Sekiguchi ..... F04D 19/04 417/324

(Continued)

FOREIGN PATENT DOCUMENTS

DE 3922782 A1 2/1990
JP S60204997 A 10/1985

(Continued)

OTHER PUBLICATIONS

Communication dated Jul. 18, 2017 and Supplemental Search Report dated Jul. 7, 2017 for corresponding European Application No. EP14865067.

(Continued)

*Primary Examiner* — Ninh H. Nguyen
(74) *Attorney, Agent, or Firm* — Westman, Champlin & Koehler, P.A.; Theodore M. Magee

(57) ABSTRACT

A vacuum pump component includes a stationary disk that is formed with a spiral groove (helical groove) having a ridge portion and a valley part and has a projecting (protruding) portion on both or either one of an inner-diameter portion of the disk which faces a rotary cylinder (rotator cylinder-shaped portion) and an inner-diameter side of a stationary cylinder disposed on an outer peripheral side of the stationary disk. A second vacuum pump component includes rotary disk formed with a spiral groove having a ridge portion and a valley part and having a projecting (protruding) portion on both or either one of an outer-diameter portion of a rotary cylinder disposed on an inner peripheral side of the rotary disk and an outer-diameter portion of the rotary disk which faces a spacer.

15 Claims, 22 Drawing Sheets

(51) Int. Cl.

| | |
|---|---|
| ***F04D 17/16*** | (2006.01) |
| ***F04D 19/04*** | (2006.01) |
| ***F04D 29/28*** | (2006.01) |
| ***F04D 29/32*** | (2006.01) |
| ***F04D 29/52*** | (2006.01) |

(52) U.S. Cl.
CPC ..... *F04D 19/042* (2013.01); *F04D 19/046* (2013.01); *F04D 29/28* (2013.01); *F04D 29/32* (2013.01); *F04D 29/522* (2013.01); *F05D 2240/12* (2013.01)

(56) References Cited

U.S. PATENT DOCUMENTS 8,070,419 B2 * 12/2011 Helmer ..... F04D 19/04
415/90
8,109,744 B2 * 2/2012 Kawasaki ..... F04D 17/168
415/110

FOREIGN PATENT DOCUMENTS

| | | | |
|---|---|---|---|
| JP | S61226596 | A | 10/1986 |
| JP | S63255598 | A | 10/1988 |
| JP | 2501275 | Y2 | 6/1996 |
| JP | 2005194994 | A | 7/2005 |

OTHER PUBLICATIONS

PCT International Search Report dated Jan. 6, 2015 for corresponding PCT Application No. PCT/JP2014/076499.
PCT International Written Opinion dated Jan. 6, 2016 for corresponding PCT Application No. PCT/JP2014/076499.

* cited by examiner

VACUUM PUMP COMPONENT, SIEGBAHN TYPE EXHAUST MECHANISM AND COMPOUND VACUUM PUMP

CROSS-REFERENCE TO RELATED APPLICATION

This application is a Section 371 National Stage application of International Application No. PCT/JP2014/076499, filed Oct. 3, 2014, which is incorporated by reference in its entirety and published as WO 2015/079801 on Jun. 4, 2015 and which claims priority of Japanese Application No 2013-245684, filed Nov. 28, 2013.

BACKGROUND OF THE INVENTION

1. Field of the Invention

The present invention relates to a vacuum pump component, a Siegbahn type exhaust mechanism, and a compound vacuum pump. More particularly, the present invention relates to a vacuum pump component and a Siegbahn type exhaust mechanism effectively connecting conduits each having an exhausting function in a vacuum pump, in which the vacuum pump component or the Siegbahn type exhaust mechanism is disposed, and a compound vacuum pump, which effectively connects conduits each having an exhausting function.

2. Description of the Related Art

A vacuum pump includes a casing forming an outer casing including an inlet port and an outlet port. In the casing, a structure which causes the vacuum pump to perform an exhausting function is contained. The structure which causes the vacuum pump to perform the exhausting function mainly includes a rotary portion (rotor portion) that is rotatably pivoted and a stationary portion (stator portion) that is fixed to the casing.

In addition, a motor for rotating a rotary shaft at a high speed is provided. When the rotary shaft is rotated at a high speed by the operation of the motor, gas is sucked in through the inlet port by the interaction of a rotor vane (rotary disk) and a stator vane (stationary disk) and exhausted through the outlet port.

Among vacuum pumps, a Siegbahn type molecular pump having a Siegbahn type configuration includes a rotary disk (rotary disc) and a stationary disk which is disposed to have a gap (clearance) with the rotary disk in an axial direction. In a surface of at least one of the rotary disk and the stationary disk which faces the gap, spiral groove (referred to also as helical groove) flow paths have been engraved. The Siegbahn type molecular pump is the vacuum pump in which the rotary disk gives a momentum in a direction tangential to the rotary disk (i.e., direction tangential to the rotating direction of the rotary disk) to gas molecules that have dispersedly entered the spiral groove flow paths. Thus, using the spiral grooves, the vacuum pump gives a dominant directionality from an inlet port toward an outlet port to the gas to exhaust the gas.

To industrially use such a Siegbahn type molecular pump or a vacuum pump having a Siegbahn type molecular pump portion, the rotary disks and the stationary disks are provided in a multi-stage configuration. This is because, when the rotary disk and the stationary disk are provided in a single stage, a compression ratio is insufficient.

Note that the Siegbahn type molecular pump is a radial flow pump element. To provide a multi-stage Siegbahn type molecular pump, a configuration is needed which exhausts gas from an inlet port to an outlet port (i.e., in the axial direction of a vacuum pump) by folding back a flow path at the outer peripheral end portions and the inner peripheral end portions of the rotary disks and the stationary disks. In the configuration, the gas is exhausted such that, e.g., after exhausted from the outer peripheral portion to the inner peripheral portion, the gas is exhausted from the inner peripheral portion to the outer peripheral portion, and then the gas is exhausted again from the outer peripheral portion to the inner peripheral portion.

Japanese Patent Application Publication No. (S) 60-204997 describes a technique in which, in a pump housing, a vacuum pump includes a turbo molecular pump portion, a spiral groove pump portion, and a centrifugal pump portion.

Japanese Utility Model Registration No. 2501275 describes a technique in which, in a Siegbahn type molecular pump, spiral grooves extending in different directions are provided in respective facing surfaces of each of rotary disks and stationary disks.

In each of the related-art configurations described above, gas molecules (gas) flow as follows.

The gas molecules transported to an inner-diameter portion of an upstream Siegbahn type molecular pump portion are exhausted into a space formed between a rotary cylinder and the stationary disk. Then, the gas molecules are attracted by suction by an inner-diameter portion of a downstream Siegbahn type molecular pump portion which is open to the space and transported to an outer-diameter portion of the downstream Siegbahn type molecular pump portion. When a multi-stage configuration is used, the flow is repeatedly observed in each of multiple stages.

However, the space (i.e., the space formed between the rotary cylinder and the stationary disk) described above has no exhausting function. Accordingly, the momentum in an exhaust direction that had been given to the gas molecules by the upstream Siegbahn type molecular pump portion was lost when the gas molecules reached the space.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

FIG. 30 is a view showing an example of a schematic configuration of a related-art Siegbahn type molecular pump 4000 to illustrate the related-art Siegbahn type molecular pump 4000. The arrows show a flow of gas molecules.

FIG. 31 is a view for illustrating each of stationary disks 5000 disposed in the related-art Siegbahn type molecular pump 4000, which is a cross-sectional view of the stationary disk 5000 when viewed from an inlet port 4 (FIG. 30) of the related-art Siegbahn type molecular pump 4000. The arrows inside the stationary disk 5000 show the flow of the gas molecules. The arrow outside the stationary disk 5000 shows the rotating direction of a rotary disk 9 (FIG. 30).

Note that, in the description given below, a side of each one of the stationary disks 5000 (in one stage) which is closer to the inlet port 4 is referred to as a Siegbahn-type-molecular-pump upstream region and a side thereof which is closer to an outlet port 6 is referred to as a Siegbahn-type-molecular-pump downstream region.

As described above, even when a dominant momentum is given to gas molecules toward the outlet port 6 in the Siegbahn type molecular pump 4000, since inwardly bent flow paths a (i.e., spaces formed between a rotary cylinder 10 and the stationary disks 5000) serving as flow paths for the gas molecules are "connecting" spaces each having no exhausting function, the given momentum is lost. As a result, the exhausting function is interrupted in each of the inwardly bent flow paths a so that the compressed gas molecules are released when passing through each of the inwardly bent flow paths a. This presents a problem in that, from the related-art Siegbahn type molecular pump 4000, an excellent exhaust efficiency cannot be obtained.

When a flow-path cross-sectional area of each of the inwardly bent flow paths a is reduced (i.e., a space formed by an outer diameter of the rotary cylinder 10 and an inner diameter of the stationary disk 5000 is reduced), the gas molecules remain in the inwardly bent flow path a to increase a flow path pressure in the inwardly bent flow path a serving as an exit (boundary point from the upstream region to the downstream region) from the Siegbahn-type-molecular-pump upstream region. As a result, a pressure loss occurs to reduce the exhaust efficiency of the entire vacuum bump (Siegbahn type molecular pump 4000).

To prevent such a reduction in exhaust efficiency, as shown in FIG. 30, it has conventionally been necessary for the inwardly bent flow path a to have a flow-path cross-sectional area and a conduit width which are sufficiently larger than a cross-sectional area and a conduit width of a conduit (gap formed by respective facing surfaces of the rotary cylinder 10 and each of the stationary disks 5000, which is a tubular flow path through which gas molecules pass) in the Siegbahn type molecular pump portion.

However, when the flow path size of each of the inwardly bent flow paths a is to be set large, an inner-diameter side thereof is limited by the size of a radial magnetic bearing device 30 which supports a rotary portion or the like. On the other hand, when a diameter of the stationary disk 5000 located on an outer-diameter side is increased, a radial dimension of the Siegbahn type molecular pump portion is reduced to reduce a width of the flow path. This presents a problem in that sufficient per-stage compression performance cannot be obtained.

To obtain a predetermined compression ratio using such a related-art technique, it is necessary to increase the number of stages in the Siegbahn type molecular pump portion. However, when the number of stages is increased, respective material/processing costs of the rotary disks 9 and the stationary disks 5000 increase to also increase the mass/inertia moment of each of the rotary disks 9 which rotate at a high speed. Accordingly, the magnetic bearing device which supports the rotary disks 9 needs extra capacity or the like, resulting in the problem of an increase in the cost of the components of the vacuum pump.

In view of this, an object of the present invention is to provide a vacuum pump component and a Siegbahn type exhaust mechanism which effectively connect conduits each having an exhausting function in a vacuum pump in which the vacuum pump component or the Siegbahn type exhaust mechanism is disposed, and a compound vacuum pump which effectively connects conduits each having an exhausting function.

To attain the foregoing object, the invention in a first aspect provides a vacuum pump component including a disk-shaped portion having a spiral groove disposed in at least a part thereof, wherein a projection is disposed on at least a part of at least any one of an inner peripheral side surface or an outer peripheral side surface of the disk-shaped portion in which the spiral groove is not disposed, an outer peripheral side surface of a cylinder-shaped portion which is disposed on an inner peripheral side of the disk-shaped portion and which is concentric to the disk-shaped portion, and an inner peripheral side surface of a cylinder-shaped portion which is disposed on an outer peripheral side of the disk-shaped portion and which is concentric to the disk-shaped portion.

The invention in a second aspect provides a vacuum pump component including a cylinder-shaped portion disposed concentrically with a disk-shaped portion having a spiral groove disposed in at least a part thereof, wherein a projection is disposed on at least a part of at least any one of an outer peripheral side surface of the cylinder-shaped portion when the disk-shaped portion is disposed on an outer peripheral side of the cylinder-shaped portion and an inner peripheral side surface of the cylinder-shaped portion when the disk-shaped portion is disposed on an inner peripheral side of the cylinder-shaped portion.

The invention in a third aspect provides the vacuum pump component in the first or second aspect, wherein the disposition number of the projection is an integral multiple of the disposition number of the spiral groove.

The invention in a fourth aspect provides the vacuum pump component in the first or second aspect, wherein the disposition number of the spiral groove is an integral multiple of the disposition number of the projection.

The invention in a fifth aspect provides the vacuum pump component in at least any one of the first to fourth aspects, wherein, at a surface where the projection is disposed, a position of the projection corresponds to a position of an end portion of a ridge portion, on a side of the surface, of the spiral groove.

The invention in a sixth aspect provides the vacuum pump component in at least any one of the first to fifth aspects, wherein, at a surface where the projection is disposed, the projection and an end portion, on a side of the surface, of a ridge portion of the spiral groove which is closer to the surface are disposed in a continuous shape.

The invention in a seventh aspect provides the vacuum pump component in at least any one of the first to sixth aspects, wherein the projection is disposed at a predetermined angle relative to a center axis of the disk-shaped portion.

The invention in an eighth aspect provides the vacuum pump component in at least any one of the first to seventh aspects, wherein the projection is disposed to have a size such that an amount of projection thereof is not less than 70% of a depth of the spiral groove at a portion thereof which is close to the projection.

The invention in a ninth aspect provides the vacuum pump component in at least any one of the first to eighth aspects, wherein the disk-shaped portion includes one or a plurality of components.

The invention in a tenth aspect provides a Siegbahn type exhaust mechanism including the vacuum pump component in any one of the first to ninth aspect, and a second component having a surface facing the spiral groove, wherein a gas is transported by an interaction of the vacuum pump component and the second component.

The invention in an eleventh aspect provides the Siegbahn type exhaust mechanism in the tenth aspect, wherein the second component and the projection are disposed to have sizes such that a distance between respective surfaces of the second component and the projection which face each other is not more than 2 mm.

The invention in a twelfth aspect provides the Siegbahn type exhaust mechanism in the tenth or eleventh aspect, wherein the projection is disposed to be inclined in a direction of exhaust in a vacuum pump including the vacuum pump component.

The invention in a thirteenth aspect provides a compound vacuum pump including, in a compounded form: the Siegbahn type exhaust mechanism in the tenth, eleventh, or twelfth aspect; and a thread groove type molecular pump mechanism.

The invention in a fourteenth aspect provides a compound vacuum pump including in a compounded form: the Siegbahn type exhaust mechanism in the tenth, eleventh, or twelfth aspect; and a turbo molecular pump mechanism.

The invention in a fifteenth aspect provides a compound vacuum pump including in a compounded form: the Siegbahn type exhaust mechanism in the tenth, eleventh, or twelfth aspect, a thread groove type molecular pump mechanism, and a turbo molecular pump mechanism.

In accordance with the present invention, it is possible to provide a vacuum pump component and a Siegbahn type exhaust mechanism which effectively connect conduits each having an exhausting function, and a compound vacuum pump which effectively connects conduits each having an exhausting function.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

(i) Outline of Each of Embodiments

Figure 1:
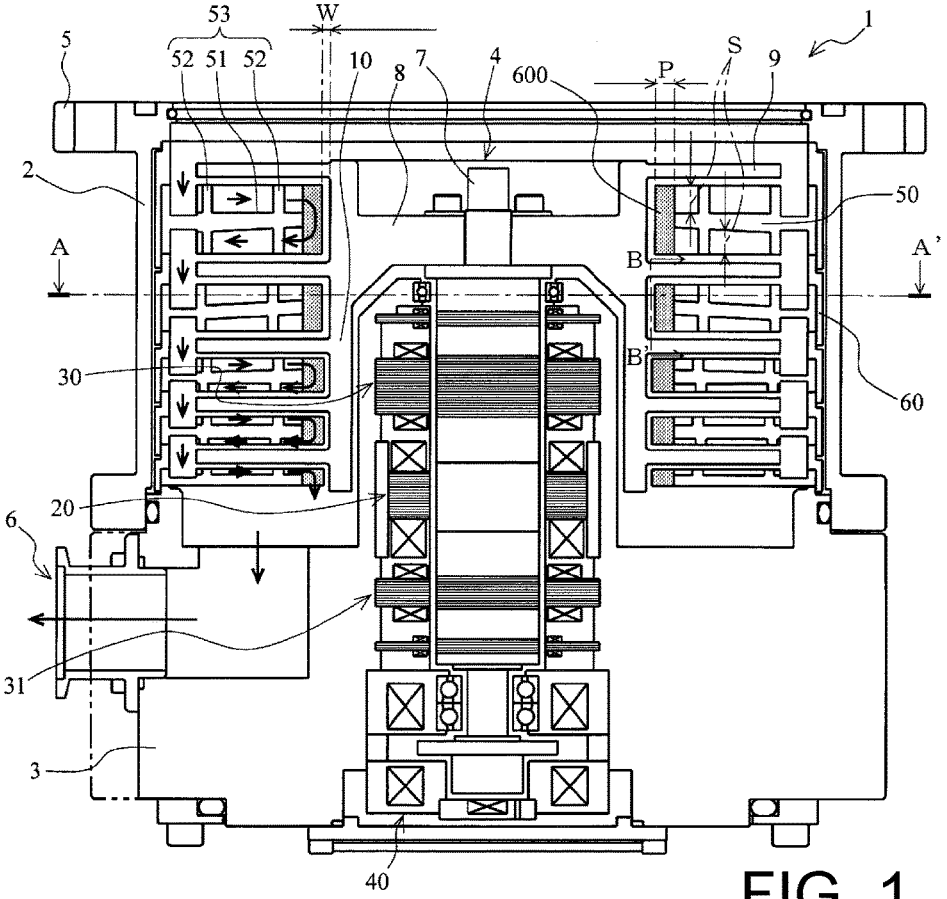
FIG. 1 is a view showing an example of a schematic configuration of a Siegbahn type molecular pump according to an embodiment of the present invention.

A vacuum pump according to each of embodiments of the present invention is a compound vacuum pump including a vacuum pump component and a Siegbahn type exhaust mechanism which effectively connect conduits each having an exhausting function.

More specifically, a stationary disk according to the embodiment of the present invention is formed with a spiral groove having a ridge portion and a valley part and has a projecting (protruding) portion on each or either one of an inner-diameter portion of the stationary disk which faces a rotary cylinder (rotator cylinder-shaped portion) and an inner-diameter side of a stationary cylinder disposed on an outer peripheral side of the stationary disk.

A rotary disk according to the embodiment of the present invention is formed with a spiral groove having a ridge portion and a valley part and has a projecting (protruding) portion on each or either one of an outer-diameter portion of a rotary cylinder disposed on an inner peripheral side of the rotary disk and an outer-diameter portion of the rotary disk which faces a spacer.

The projecting portion (protruding portion) configured in a protruding shape is formed in such a manner that ridge portions (stationary-disk ridge portions) of the respective spiral grooves in an upstream region (surface closer to an inlet port) of the stationary disk and a downstream region (surface closer to an outlet port) thereof are extended be joined together, projecting portions are provided on a surface where the spiral grooves are not formed, or a skew plate is disposed in either or each one of the inner-diameter portion and the outer-diameter portion.

In each of the embodiments of the present invention, regions where the projecting portions are formed (gas flow paths) allow the continuity of exhaust to be retained between a Siegbahn-type-molecular-pump upstream region and a Siegbahn-type-molecular-pump downstream region each having an exhausting function.

(ii) Details of Embodiments

The following will describe the preferred embodiments of the present invention in detail with reference to FIGS. 1 to 31.

Note that, in the present embodiment, the description will be given using a Siegbahn type molecular pump as an example of a vacuum pump and it is assumed that a direction perpendicular to a diametrical direction of a rotary disk is an axial direction (center axis).

The description will also be given below by respectively referring to an inlet port side and an outlet port side of one (one-stage) stationary disk as the Siegbahn-type-molecular-pump upstream region and the Siegbahn-type-molecular-pump downstream region.

First, a description will be given below of an example of a configuration of a Siegbahn type exhaust mechanism and a vacuum pump having the Siegbahn type exhaust mechanism. The Siegbahn type exhaust mechanism exhausts gas in a flow (configuration in which the path of the gas is folded back) in which the gas in the Siegbahn-type-molecular-pump upstream region is exhausted from the outer-diameter portion thereof to the inner-diameter portion thereof and then the gas in the Siegbahn-type-molecular-pump downstream region is exhausted from the inner-diameter portion thereof to the outer-diameter portion thereof.

Note that, in each of the embodiments of the present invention, the Siegbahn type exhaust mechanism shows a mechanism (configuration) which transports gas using an interaction of a first component formed with spiral grooves and a second component having a surface facing the first component.

(ii-1) Configuration

FIG. 1 is a view showing an example of a schematic configuration of a Siegbahn type molecular pump 1 according to the first embodiment of the present invention.

Note that FIG. 1 shows a cross-sectional view of the Siegbahn type molecular pump 1 in an axial direction thereof. A casing 2 forming an outer casing of the Siegbahn type molecular pump 1 has a generally cylindrical shape to form a housing of the Siegbahn type molecular pump 1 in conjunction with a base 3 provided in a lower part (closer to an outlet port 6) of the casing 2. In the housing, a gas transport mechanism as a structure which causes the Siegbahn type molecular pump 1 to perform an exhausting function is contained.

The gas transport mechanism mainly includes a rotary portion that is rotatably supported (pivoted) and a stationary portion that is fixed to the housing.

In an end portion of the casing 2, an inlet port 4 for introducing gas into the Siegbahn type molecular pump 1 is formed. At an end surface of the casing 2 closer to the inlet port 4, a flange portion 5 which projects on an outer peripheral side of the Siegbahn type molecular pump 1 is formed.

In the base 3, the outlet port 6 for exhausting the gas from the Siegbahn type molecular pump 1 is formed.

The rotary portion includes a shaft 7 as a rotary shaft, a rotor 8 disposed around the shaft 7, a plurality of rotary disks 9 provided in the rotor 8, a rotary cylinder 10, and the like. Note that the shaft 7 and the rotor 8 form a rotor portion.

Each of the rotary disks 9 is made of a disk member having a disk shape extending radially to be perpendicular to an axis of the shaft 7.

The rotary cylinder 10 is made of a cylindrical member having a cylindrical shape that is concentric to a rotation axis of the rotor 8.

At a midpoint in the shaft 7 in the axial direction, a motor portion 20 for rotating the shaft 7 at a high speed is provided.

In addition, on both sides of the motor 20 of the shaft 7, radial magnetic bearing devices 30 and 31 for supporting (pivoting) the shaft 7 in a radial direction (diametrical direction) in non-contact relation are provided to be closer to the inlet port 4 and the outlet port 6, respectively. At the lower end of the shaft 7, an axial magnetic bearing device 40 for supporting (pivoting) the shaft 7 in the extending direction of the axis (axial direction) in non-contact relation is provided.

On an inner peripheral side of the housing, the stationary portion (stator portion) is formed. The stationary portion includes a plurality of stationary disks 50 provided closer to the inlet port 4 and the like. In each of the stationary disks 50, spiral groove portions 53 which are spiral grooves each including a stationary-disk ridge portion 51 and a stationary-disk valley part 52 are engraved.

Note that a description will be given of each of a configuration in which the spiral grooves (spiral groove portions 53) are engraved in the stationary disks 50 in the present embodiment and a configuration in which spiral grooves (spiral groove portions 93 described later) are engraved in the rotary disks 9 in another embodiment. Spiral groove flow paths including the spiral grooves may be engraved appropriately in the surface of at least either one of the rotary disks 9 and the stationary disks 50 which faces a gap.

Each of the stationary disks 50 is configured of a disk member having a disk shape extending radially to be perpendicular to the axis of the shaft 7.

The stationary disks 50 in individual stages are spaced apart from each other by a spacer 60 having a cylindrical shape to be stationary. Each of the arrows in FIG. 1 shows a gas flow. Note that, in each of the drawings showing the present embodiment, for the sake of illustration, the arrows each showing the gas flow are shown in parts of the drawing.

In the Siegbahn type molecular pump 1, the rotary disks 9 and the stationary disks 50 are alternately arranged to be formed in a plurality of stages in the axial direction. To satisfy exhaust performance required of a vacuum pump, any number of rotor components and any number of stator components can be provided as necessary.

The Siegbahn type molecular pump 1 thus configured is intended to perform an evacuation process in a vacuum chamber (not shown) disposed in the Siegbahn type molecular pump 1.

(ii-2) First Embodiment

First, a description will be given of the first embodiment in which the spiral groove portions 53 each including the stationary-disk valley part 51 and the stationary-disk ridge portion 52 are formed in each of the stationary disks 50 and projecting portions 600 are disposed on an inner peripheral side of the stationary disk 50 where no spiral groove portion is formed.

As shown in FIG. 1, the Siegbahn type molecular pump 1 according to the first embodiment has the projecting portions 600 along an inner periphery of each of the stationary disks 50 disposed therein.

More specifically, each of the stationary disks 50 disposed in the Siegbahn type molecular pump 1 has the projecting portions 600 formed by extending, on the inner-diameter side of the stationary disk 50 where the stationary disk 50 faces the rotary cylinder 10, both of ridge portions (stationary-disk ridge portion 52) of the spiral grooves formed in an upstream region (surface closer to the inlet port 4) and ridge portions (stationary-disk ridge portions 52) of the spiral grooves formed in a downstream region (surface closer to the outlet port 6) such that the extended ridge portions are joined together.

Figure 2:
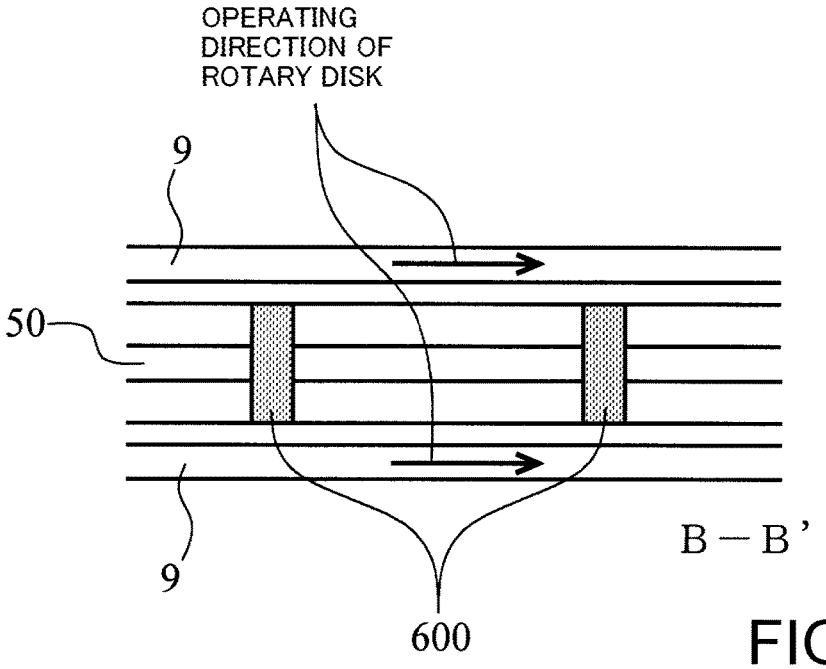
FIG. 2 is an enlarged view for illustrating each of stationary disks according to the embodiment of the present invention.

FIG. 2 is a view for illustrating each of the stationary disks 50 according to the first embodiment, which is a cross-sectional view (cross-sectional view when the casing 2 is viewed from the shaft 7) along the line B-B' in FIG. 1.

As shown in FIG. 2, in the stationary disk 50, the projecting portions 600 each disposed at an angle generally perpendicular to a movement direction of each of the rotary disks 9 are formed to project in an inner peripheral direction from the stationary disk 50 (in FIG. 1, from the inner peripheral side surface of the stationary disk 50 in the direction of the motor portion 20).

In the first embodiment, by the projecting portions 600, respective flow paths upstream and downstream of the stationary disk 50 are connected. That is, by forming the projecting portions 600, the Siegbahn-type-molecular-pump upstream region and the Siegbahn-type-molecular-pump downstream region each having an exhausting function (i.e., having a spiral groove structure) are continued to each other in a form which does not interrupt the exhausting function.

Thus, in the first embodiment, the flow path through which gas molecules (gas) flowing in the region of the Siegbahn type exhaust mechanism (Siegbahn type molecular pump portion) pass extends as an inwardly bent flow path not in a space having no exhausting/compressing functions such as the related-art inwardly bent flow path a (see FIGS. 30 and 31), but in a space (gap) between the rotary cylinder 10 and the inner-diameter side surface of each of the stationary disks 50 where the projecting portions 600 formed in the stationary disk 50 are present.

Figure 3:
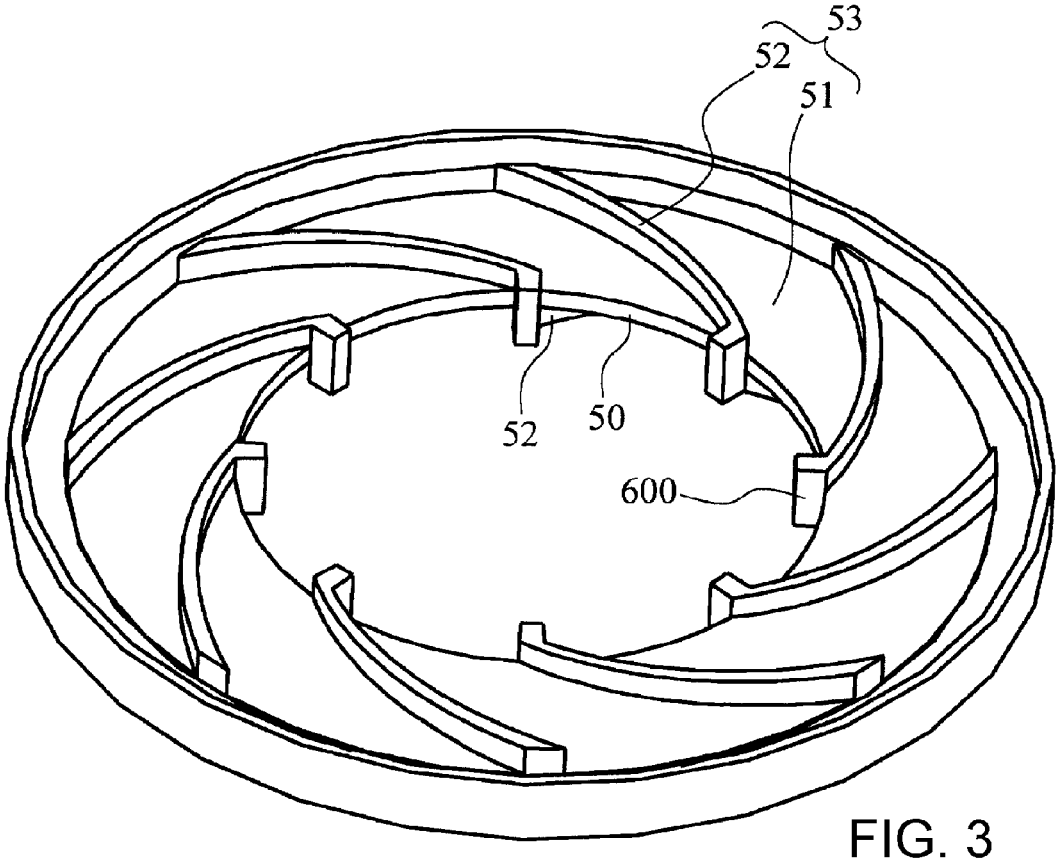
FIG. 3 is a view for illustrating the stationary disk according to the embodiment of the present invention.
Figure 4:
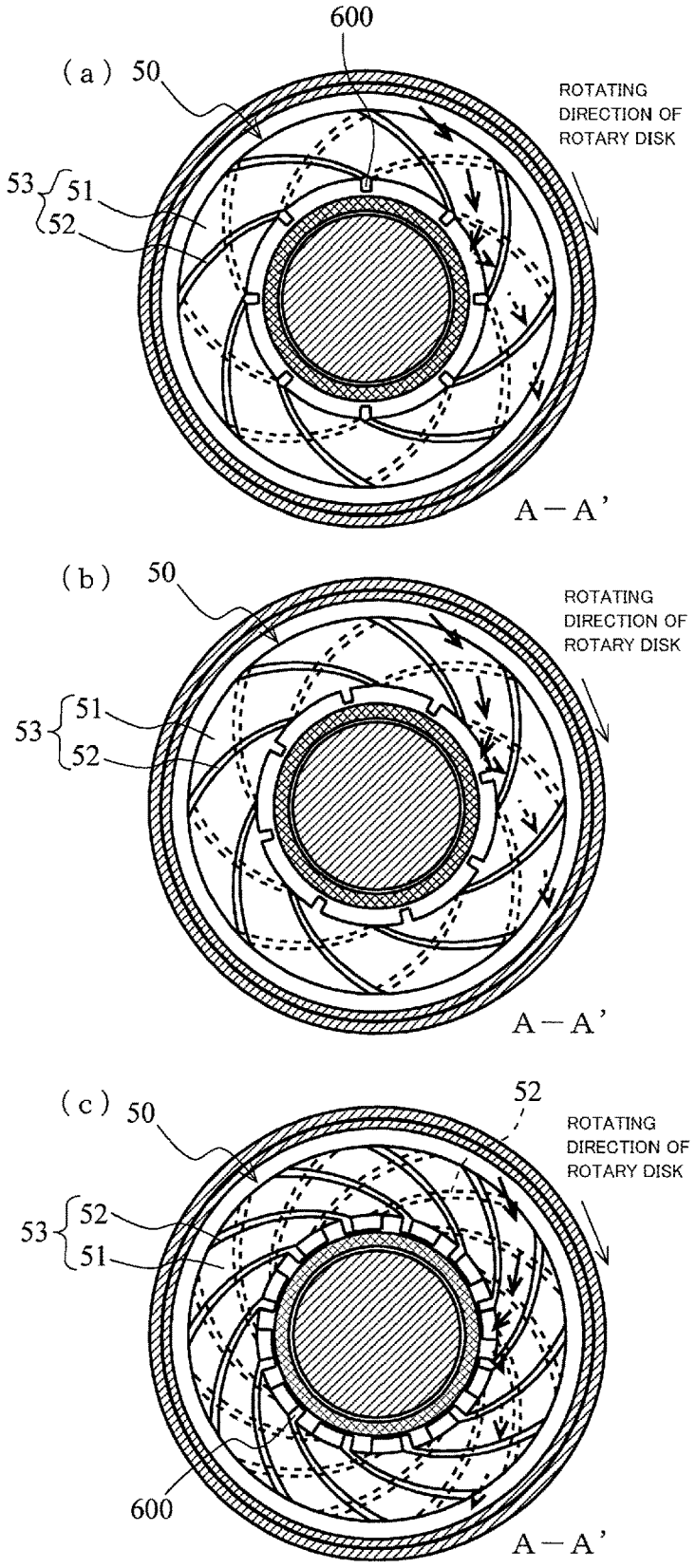
FIGS. 4A to 4C are views each for illustrating the stationary disk according to the embodiment of the present invention.

FIG. 3 is a perspective projection view when each of the stationary disks 50 according to the first embodiment is viewed from the inlet port 4.

As shown in FIG. 3, the stationary disk 50 having the spiral groove portions 53 each including the stationary-disk valley part 51 and the stationary-disk ridge portion 52 and formed in the upper and lower surfaces of the stationary disk 50 has the projecting portions 600 which are formed on the inner-diameter side surface thereof facing the rotary cylinder 10 (FIG. 1).

In the first embodiment, the phase of the stationary-disk ridge portions 52 formed in the upper surface of the stationary disk 50 matches the phase of the stationary-disk ridge portions 52 formed in the lower surface thereof. In addition, the projecting portions 600 and the stationary-disk ridge portions 52 are formed continuously in an integral configuration.

FIG. 4A is a view for illustrating each of the stationary disks 50 according to the first embodiment, which corresponds to FIG. 3. FIG. 4A is a cross-sectional view when the Siegbahn type molecular pump 1 in which the stationary disks 50 shown in FIG. 3 are disposed is viewed in the A-A' direction (from the inlet port 4) in FIG. 1. In the drawing, the spiral groove portions closer to the outlet port 6 (on a downstream side) are shown by the broken lines.

Note that, in FIG. 4A, the solid-line arrows shown in the stationary disk 50 show parts of the flow of the gas molecules which pass through the spiral groove portions 53 (stationary-disk valley parts 51) formed in the upstream surface of the stationary disk 50. On the other hand, in the drawing, the broken-line arrows shown in the stationary disk 50 show parts of the flow of the gas molecules which pass through the spiral groove portions 53 (stationary-disk valley parts 51) formed in the downstream surface of the stationary disk 50.

As shown in FIGS. 3 and 4A, in the first embodiment, the stationary-disk ridge portions 52 formed in the upstream surface (surface closer to the inlet port 4) of the stationary disk 50, the projecting portions 600, and the stationary-disk ridge portions 52 formed in the downstream surface (surface closer to the outlet port 6) of the stationary disk 50 are formed continuously in an indiscrete and connected state into an integral configuration.

As described above, in the Siegbahn type molecular pump 1 having the stationary disks 50 according to the first embodiment, peaks (stationary-disk ridge portions 52) of the spiral groove portions 53 of the stationary disk 50 and the projecting portions 600 are connected in an indiscrete and continuous configuration.

Due to this configuration, the flow paths formed between the projecting portions 600 and the flow paths formed between the stationary-disk ridge portions 52 are continuously connected. As a result, the "momentum dominant in the exhaust direction" that has been given by the upstream spiral groove portions 53 (closer to the inlet port 4) to the gas (gas molecules) is less likely to be lost. Thus, the effect of preventing the momentum from being dissipated due to the discontinuity of the space formed by the rotary cylinder 10 and a conduit (exhaust flow path in a radial direction of the Siegbahn type molecular pump 1) can be obtained.

Note that the "momentum dominant in the exhaust direction" is the momentum that has been given to gas molecules by the axial-direction/inner-diameter-side flow paths in the Siegbahn type molecular pump 1 (Siegbahn type exhaust mechanism) so as to be dominant in the direction of exhaust of the gas molecules.

In addition, the respective stationary-disk ridge portions 52 formed in the upper and lower surfaces of the stationary disk 50 have the same phase and the projecting portions 600 are disposed so as to connect the respective end surfaces of the upper and lower stationary-disk ridge portions 52.

Due to the configuration, the flow paths formed between the projecting portions 600 and the flow paths formed between the peaks (stationary-disk ridge portions 52) of the spiral groove portions 53 are continuously connected. Accordingly, the "momentum dominant in the exhaust direction" that has been given by the upstream spiral groove portions 53 to the gas is less likely to be lost. That is, the effect of preventing the momentum from being dissipated due to the discontinuity of the space formed by the rotary cylinder 10 and the conduit (exhaust flow path in a radial direction of the Siegbahn type molecular pump 1) can be obtained.

As described above, the first embodiment is configured such that the phases of the respective stationary-disk ridge portions 52 formed in the upper and lower surfaces of the stationary disk 50 match each other and the projecting portions 600 and the end surfaces (inner-diameter end surfaces) of the respective stationary-disk ridge portions 52 in the upper and lower surfaces are formed continuously into an integral configuration. However, the configuration of the first embodiment is not limited thereto.

As shown in FIG. 4B, the configuration may also be such that the positions at which the projecting portions 600 are formed on the stationary disk 50 do not correspond to the end surfaces of the stationary-disk ridge portions 52 in the inner-diameter direction thereof, i.e., the projecting portions 600 and the stationary-disk ridge portions 52 are formed in discontinuous relation.

Alternatively, as shown in FIG. 4C, the configuration may also be such that the phase of the stationary-disk ridge portions 52 of the spiral groove portions 53 (shown by the solid lines) formed in the upper surface of the stationary disk 50 does not match the phase of the stationary-disk ridge portions 52 of the spiral groove portions 53 (shown by the broken lines) formed in the lower surface thereof. In the case where the respective phases of the upper stationary-disk ridge portions 52 and the lower stationary-disk ridge portions 52 do not match, as shown in FIG. 4C, the configuration is preferably such that the stationary-disk ridge portions 52 (solid lines) formed in the upstream side of the stationary disk 50 and upstream end portions of the projecting portions 600 and the stationary-disk ridge portions 52 (broken lines) formed in the downstream side of the stationary disk 50 and downstream end portions of the projecting portions 600 are continuously formed. In this case, each of the projecting portions 600 is configured such that a predetermined angle is formed between the projecting portion 600 and the axial direction of the Siegbahn type molecular pump 1. Note that the configuration when the predetermined angle is formed between each of the projecting portions 600 and the axial direction of the Siegbahn type molecular pump 1 will be described later in detail (Modification 3).

Alternatively, the configuration may also be such that the phase of the stationary-disk ridge portions 52 of the spiral groove portions 53 formed in the upper surface (solid lines) of the stationary disk 50 does not match the phase of the stationary-disk ridge portions 52 of the spiral groove portions 53 formed in the lower surface (broken lines) thereof and the projecting portions 600 are formed in parallel with the axial direction of the Siegbahn type molecular pump 1, though not shown. In this case, the projecting portions 600 are configured to be formed on the inner peripheral surface of the stationary disk 50 in any of the states where the stationary-disk ridge portions 52 (solid lines) formed in the upstream side of the stationary disk 50 are continued to the upstream end portions of the projecting portions 600, where the stationary-disk ridge portions 52 (broken lines) formed in the downstream side of the stationary disk 50 are continued to the downstream end portions of the projecting portions 600, and where both the upstream end portions and the downstream end portions of the projecting portions 600 are discontinued from the stationary-disk ridge portions 52.

(ii-3) Second Embodiment

Figure 5:
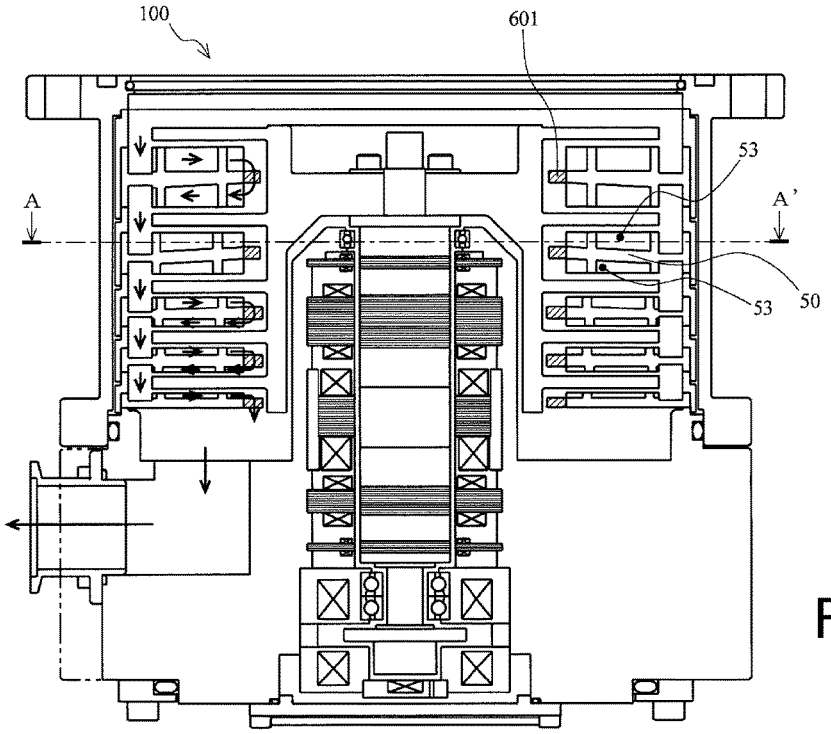
FIG. 5 is a view showing an example of a schematic configuration of a Siegbahn type molecular pump according to another embodiment of the present invention.

FIG. 5 is a view showing an example of a schematic configuration of a Siegbahn type molecular pump 100 according to the second embodiment. For the same components as in FIG. 1, reference numerals and a description thereof are omitted.

Figure 6:
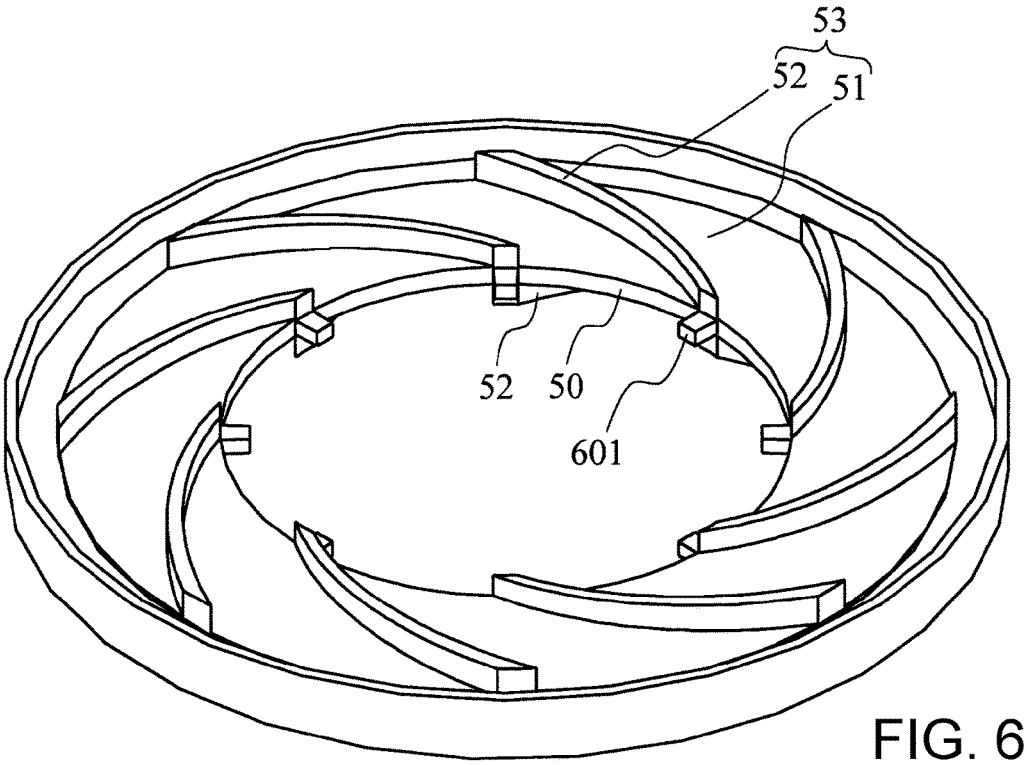
FIG. 6 is a view for illustrating each of stationary disks according to the other embodiment of the present invention.
Figure 7:
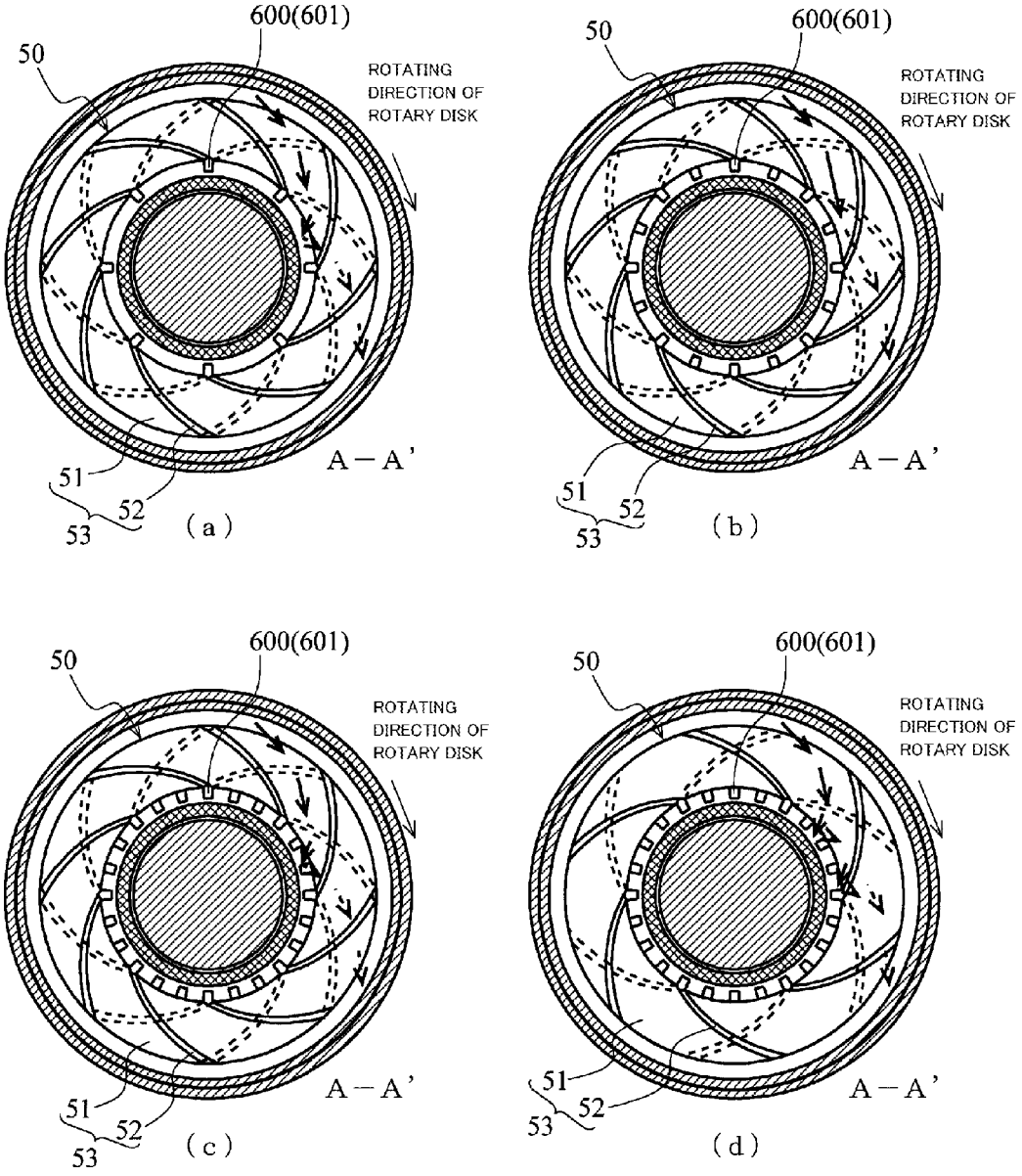
FIGS. 7A to 7D are views each for illustrating the stationary disk according to each of the embodiment and the other embodiment of the present invention.
Figure 8:
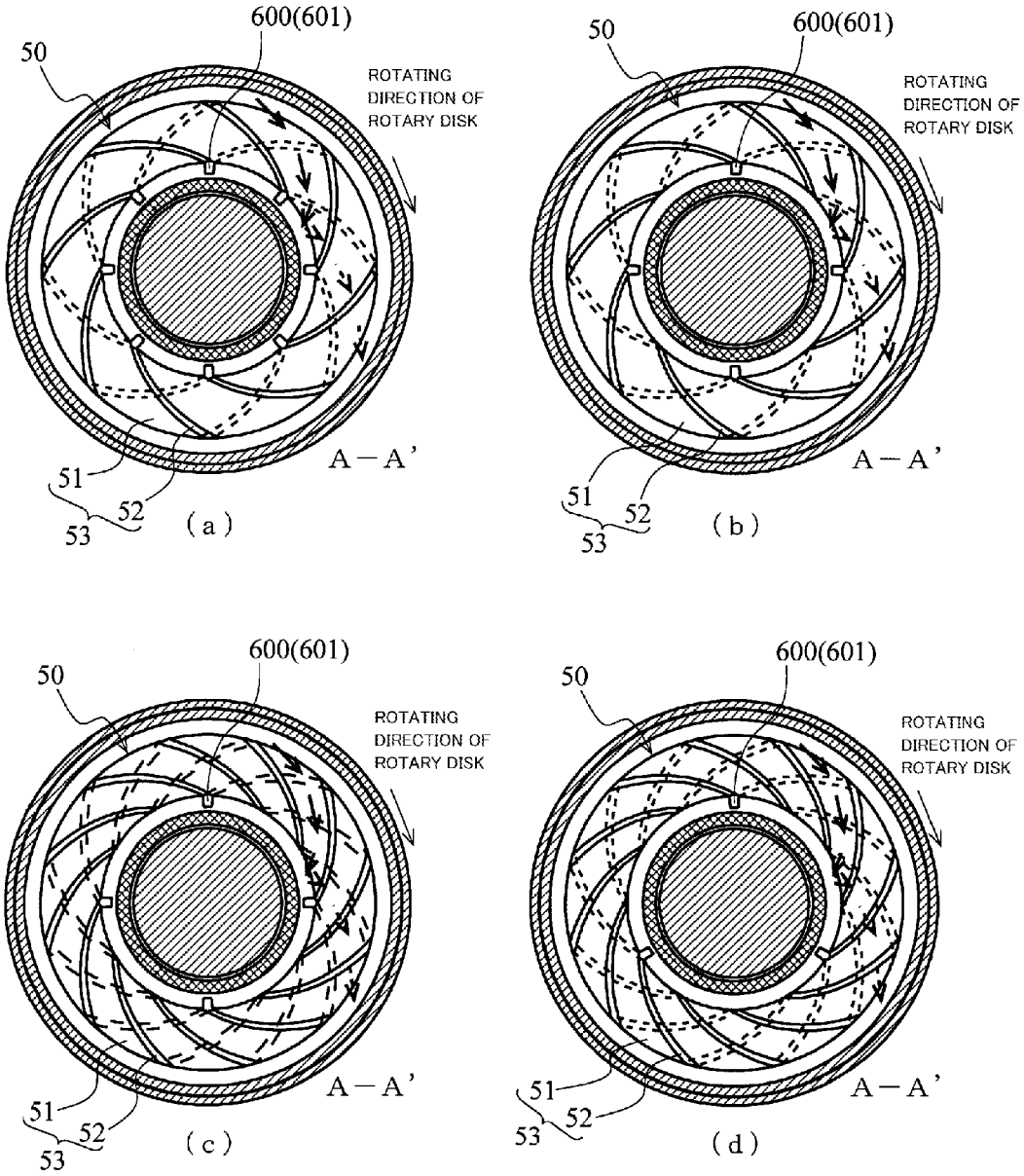
FIGS. 8A to SD are views for illustrating the stationary disk according to each of the embodiment and the other embodiment of the present invention.

FIG. 6 is a perspective view when each of the stationary disks 50 according to the second embodiment is shown from the inlet port 4.

The second embodiment is different from the first embodiment in that each of projecting portions (protruding portions) 601 formed on the stationary disk 50 is formed to have the same width (width in the axial direction) as the width of an inner-diameter side surface of the stationary disk 50 in the axial direction.

That is, in the second embodiment, the projecting portions 601 are disposed on the stationary disk 50 in a state where the projecting portions 601 are not continued to the peaks (stationary-disk ridge portions 52) of the spiral groove portions 53 at the inner-diameter-side end of the stationary disk 50.

Note that a width in a direction orthogonal to the axial direction described above may have, e.g., generally the same value as that of a width orthogonal to the axial direction in a cross section of the stationary-disk ridge portions 52 in the axial direction as shown in FIG. 6 or may be larger or smaller than the width.

Also, each of the first and second embodiments described above is configured such that the number of the projecting portions 600 (601) disposed on the stationary disk 50 is the same as the number of the peaks (stationary-disk ridge portions 52) of the spiral grooves 53 engraved in the stationary disk 50, but the configuration of each of the first and second embodiments is not limited thereto.

Preferably, the disposition number of the projecting portions 600 (601) is an integral multiple of the disposition number of the stationary-disk ridge portions 52.

(ii-4-1) Modification 1 of Each of First/Second Embodiments

FIGS. 7A to 7D are views each for illustrating each of the stationary disks 50 according to Modification 1 of each of the first and second embodiments, which are cross-sectional views when the stationary disk 50 is viewed from the inlet port 4 in the A-A' direction in FIG. 1 or 5. In each of the drawings, spiral groove portions closer to the outlet port 6 (on the downstream side) are shown by the broken lines.

Each of the first and second embodiments is configured such that, as shown in FIG. 7A, the number of the projecting portions 600 (601) disposed on the stationary disk 50 is 8 which is the same as (as large as) the number of the peaks (stationary-disk peaks 52) of the spiral groove portions 53 engraved in the stationary disk 50.

By contrast, Modification 1 may also be configured such that, e.g., the number of the stationary-disk ridge portions 52 engraved in the stationary disk 50 is 8 and the number of the projecting portions 600 (601) is 16 which is twice as large as 8, as shown in FIG. 7B.

Alternatively, as shown in FIG. 7C, the configuration may also be such that, e.g., the number of the stationary-disk ridge portions 52 engraved in the stationary disk 50 is 8 and the number of the projecting portions 600 (601) is 24 which is three times as large as 8.

Alternatively, as shown in FIG. 7D, the configuration may also be such that, e.g., the number of the stationary-disk ridge portions 52 engraved in the stationary disk 50 is 6 and the number of the projecting portions 600 (601) is 24 which is four times as large as 6.

In short, in each of the drawings of FIGS. 7A to 7D, the configuration is such that the disposition number of the projecting portions 600 (601) is an integral multiple (n=1, 2, 3, . . . ) of the disposition number of the stationary-disk ridge portions 52.

(ii-4-2) Modification 2 of Each of First/Second Embodiments

In the same manner as in Modification 1, the disposition number of the stationary-disk ridge portions 52 may also be an integral multiple of the disposition number of the projecting portions 600 (601). A description will be given of a configuration of Modification 2 using FIGS. 8A to 8D.

FIGS. 8A to 8D are views for illustrating each of the stationary disks 50 according to Modification 2 of each of the first and second embodiments, which are cross-sectional views when the stationary disk 50 is viewed from the inlet port 4 in the A-A' direction in FIG. 1 or 5. In each of the drawings, spiral groove portions closer to the outlet port 6 (on the downstream side) are shown by the broken lines.

Each of the first and second embodiments is configured such that, as shown in FIG. 8A, the number of the projecting portions 600 (601) disposed on the stationary disk 50 is 8 which is the same as (as large as) the number of the peaks (stationary-disk ridge portions 52) of the spiral groove portions 53 engraved in the stationary disk 50.

By contrast, Modification 2 may also be configured such that, e.g., the number of the projecting portions 600 (601) is 4 and the number of the stationary-disk ridge portions 52 engraved in the stationary disk 50 is 8 which is twice as large as 4, as shown in FIG. 8B.

Alternatively, as shown in FIG. 8C, the configuration may also be such that, e.g., the number of the projecting portions 600 (601) is 4 and the number of the stationary-disk ridge portions 52 engraved in the stationary disk 50 is 12 which is three times as large as 4.

Alternatively, as shown in FIG. 8D, the configuration may also be such that, e.g., the number of the projecting portions 600 (601) is 3 and the number of the stationary-disk ridge portions 52 engraved in the stationary disk 50 is 12 which is four times as large as 3.

In short, in each of the drawings of FIGS. 8A to 8D, the configuration is such that the disposition number of the stationary-disk ridge portions 52 is an integral multiple (n=1, 2, 3, . . . ) of the disposition number of the projecting portions 600 (601).

The projecting portions 600 (601) need not be disposed to have the same pitch (dimension between the ridge portions) as that of the spiral groove portions 53, unlike in each of Modifications 1 and 2 of each of the first/second embodiments described above. That is, the projecting portions 600 (601) may also be disposed to have a pitch different from the pitch of the stationary-disk ridge portions 52.

In particular, when the pressure in the outlet port 6 of the Siegbahn type molecular pump 1 (100) is high and there are numerous reverse flow components of gas molecules, to improve an anti-reverse-flow effect, the configuration is preferably such that the pitch of the projecting portions 600 (601) is increased.

(ii-4-3) Modification 3 of Each of First/Second Embodiments

Next, a description will be given of a form in which projecting portions of stationary disks disposed in a Siegbahn type molecular pump are disposed on the stationary disks in a state where a predetermined angle is formed between each of the projecting portions and an axial direction of the Siegbahn type molecular pump (i.e., in oblique relation).

Figure 9:
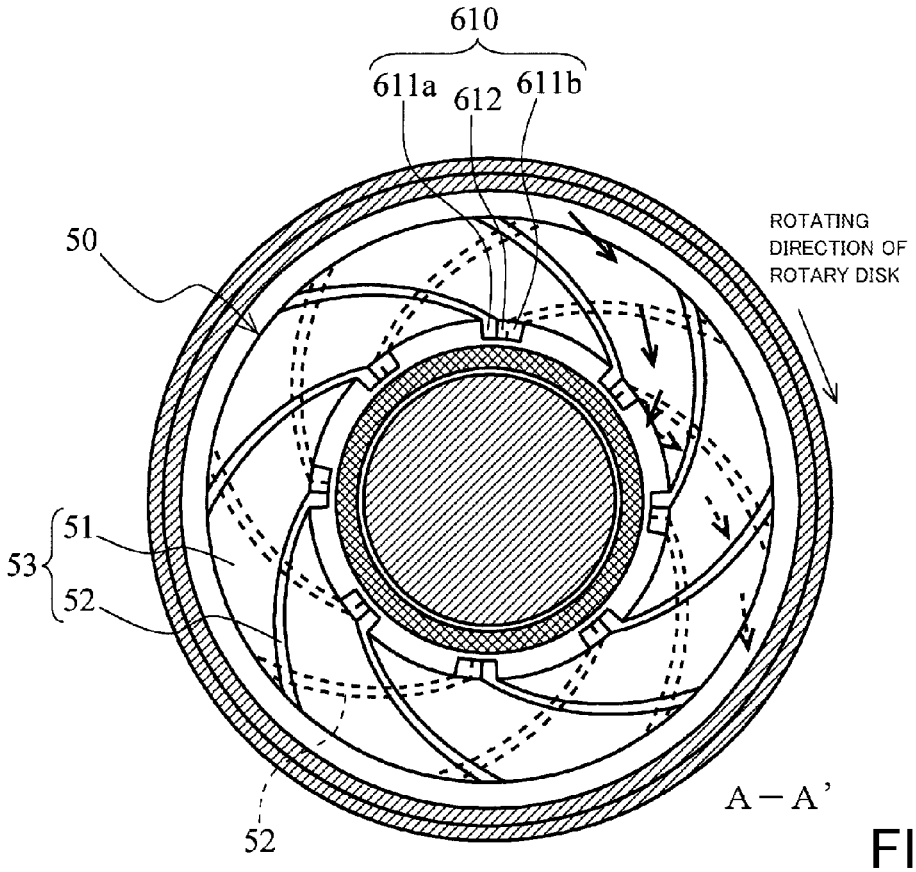
FIG. 9 is a view for illustrating the stationary disk according to each of the embodiment and the other embodiment of the present invention.

FIG. 9 is a view for illustrating each of the stationary disks 50 according to Modification 3 of each of the first and second embodiments, which is a cross-sectional view when the stationary disk 50 is viewed from the inlet port 4 in the A-A' direction in FIG. 1 or 5. In the drawing, the spiral groove portions closer to the outlet port 6 (on the downstream side) are shown by the broken lines.

Figure 10:
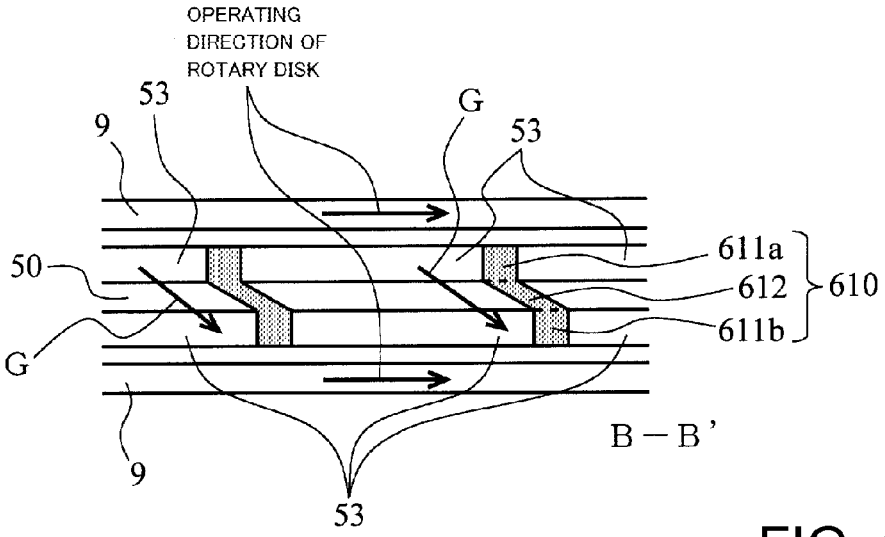
FIG. 10 is an enlarged view for illustrating the stationary disk according to each of the embodiment and the other embodiment of the present invention.

FIG. 10 is an enlarged view for illustrating the stationary disk 50 according to Modification 3 of each of the first and second embodiments, which is a cross-sectional view (cross-sectional view when the casing 2 is viewed from the shaft 7) along the line B-B' in FIG. 1 or 5.

As shown in FIG. 10, on the stationary disk 50, projecting portions 610 each disposed at an angle generally perpendicular to the movement direction (tangential direction) of each of the rotary disks 9 are formed to project in an inner peripheral direction from the stationary disk 50 (in FIG. 5, from the inner peripheral side surface of the stationary disk 50 toward the motor portion 20).

In Modification 3 of each of the first and second embodiments, as shown in FIGS. 9 and 10, the phases of the stationary-disk ridge portions 52 of the respective spiral groove portions 53 formed in the upper and lower surfaces of the stationary disk 50 do not match (are shifted from each other) in the inner-diameter-side bent flow paths formed by the stationary disks 50 and the rotary cylinder 10.

In other words, the stationary-disk ridge portions 52 are formed at positions which are different on the upper surface (shown by the solid lines in FIG. 9) and on the lower surface (shown by the broken lines in FIG. 9) (i.e., positions different above and below the stationary disk 50 interposed therebetween when viewed in cross section).

In Modification 3 which does not provide a match between the respective phases of the spiral groove portions 53 in the upper and lower surfaces, the projecting portions 610 are formed on the stationary disk 50 as follows. Modification 3 is configured such that the stationary-disk ridge portions 52 (solid lines in FIG. 9) formed on the upstream side of the stationary disk 50 and extended portions 611*a* as upstream end portions of the projecting portions 610 and the stationary-disk ridge portions 52 (broken lines in FIG. 9) formed on the downstream side of the stationary disk 50 and extended portions 611*b* as downstream end portions of the projecting portions 610 are formed continuously via inclined portions 612.

Due to this configuration, each of the projecting portions 610 including the extended portion 611*a*, the inclined portion 612, and the extended portion 611*b* is configured such that a predetermined angle is formed between the inclined portion 612*a* and the axial direction of the Siegbahn type molecular pump 1.

More specifically, the projecting portions 610 are disposed stationary such that an inner-diameter side surface (surface where the spiral groove portions 53 are not formed) of the stationary disk 50 in the axial direction which faces the rotary cylinder 10 via a space is formed with an inclined surface projecting into the space and inclined in a downstream direction toward a direction in which the rotary disk 9 rotates (hereinafter referred to as the rotating direction), while being spaced apart from the rotary cylinder 10. That is, the inclined portion 612 of each of the projecting portions 610 has a downward angle (depression angle or angle of depression, which is hereinafter generally referred to as the depression angle) relative to the stationary disk 50 serving as a horizontal reference).

That is, in Modification 3 of each of the first/second embodiments, the inclined portion 612 of each of the projecting portions 610 is configured to be inclined in the exhaust direction of the Siegbahn type molecular pump 1 (100).

A specific description will be given of formation of the inclined portions 612.

First, on the inner-diameter side surface of the stationary disk 50, the extended portions 611*a* are formed by extending end portions of the stationary-disk ridge portions 52 formed in the upstream region (surface closer to the inlet port 4) which are closer to an inner-diameter side of the stationary disk 50 and the extended portions 611*b* are formed by extending end portions of the stationary-disk ridge portions 52 formed in the downstream region (surface closer to the outlet port 6) which are closer to the inner-diameter side of the stationary disk 50.

Then, the extended portions 611*a* and 611*b* are caused to cover the inner-diameter side of the stationary disk 50 and be joined together such that a predetermined angle (depression angle) facing downward from the extended portion 611*a* toward the extended portion 611*b* or a predetermined angle (elevation angle) facing upward from the extended portion 611*b* toward the extended portion 611*a* is formed therebetween, thus forming the projecting portion 610. Of the projecting portion 610, the covering/joined portion forms the inclined portion 612.

That is, as shown in FIG. 10, when the movement direction of each of the rotary disks 9 is assumed to be a forward travelling direction, the extended portion 611*b* formed on the downstream surface of the stationary disk 50 is disposed to be located forward of the extended portion 611*a* formed on the upstream surface of the stationary disk 50.

Then, each of the inclined portions 612 is provided so as to form an angle (depression angle) facing downward from the surface (horizontal reference) where the extended portion 611*a* is in contact with the stationary disk 50 toward the surface where the extended portion 611*b* is in contact with the stationary disk 50. The extended portion 611*a*, the inclined portion 612, and the extended portion 611*b* form each of the projecting portions 610.

Thus, in Modification 3 of each of the first/second embodiments, the inclined portion 612 of each of the projecting portions 610 is configured to be inclined in an exhaust direction G of the Siegbahn type molecular pump 1 (100).

In the configuration described above, on the inner-diameter side of the stationary disk 50 serving as the flow paths (bent flow paths) in the axial direction of the Siegbahn type molecular pump 1 (100) described above, the stationary disk 50 includes the projecting portions 610 each projecting from the inner-diameter side surface of the stationary disk 50 and having the inclined portion 612. Due to this configuration, in Modification 3 of each of the first and second embodiments, gas molecules enter a lower surface (surface facing the outlet port 6) of the inclined portion 612 of each of the projecting portions 610 preferentially to an upper surface (surface facing the inlet port 4) thereof.

Since the inclined portion 612 is inclined at the angle (depression angle) facing downward relative to the stationary disk 50 serving as the horizontal reference toward the rotating direction of the rotary disk 9, the gas molecules are reflected preferentially downstream. This results in the probability of downstream diffusion higher than the probability of reverse diffusion to produce the exhausting function in the inner-diameter-side bent flow paths.

Thus, in Modification 3 of each of the first and second embodiments, it is possible to prevent the momentum that has been given to the gas molecules by the Siegbahn type exhaust mechanism of the Siegbahn type molecular pump 1 (100) in the inner-diameter-side bent flow paths to be dominant in the exhaust direction from being dissipated and also produce a drag effect in each of the bent portions. This can minimize a loss in the inner-diameter-side bent flow path.

(ii-5) Third Embodiment

Next, a description will be given of the third embodiment in which spiral groove portions are formed in each of rotary disks and projecting portions are disposed on an outer peripheral side of the rotary disk where no spiral groove portion is formed.

Figure 11:
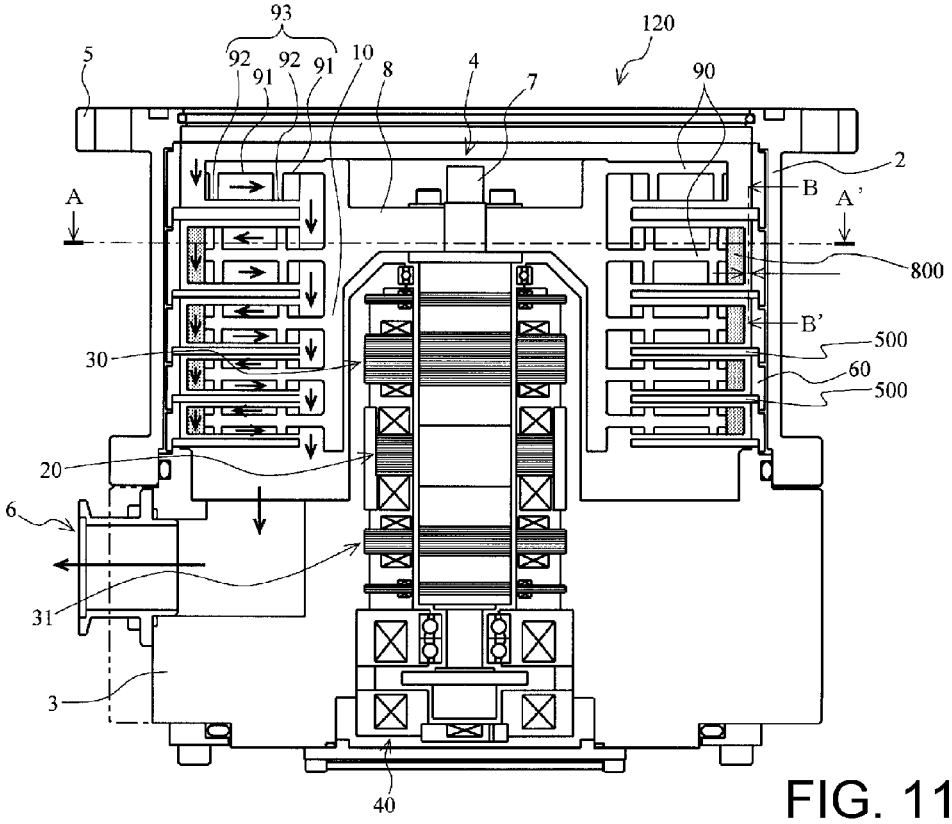
FIG. 11 is a view showing an example of a schematic configuration of a Siegbahn type molecular pump according to still another embodiment of the present invention.

FIG. 11 is a view showing an example of a schematic configuration of a Siegbahn type molecular pump 120 according to the third embodiment. Note that the same components as in FIG. 1 are designated by the same reference numerals and a description thereof is omitted.

Figure 12:
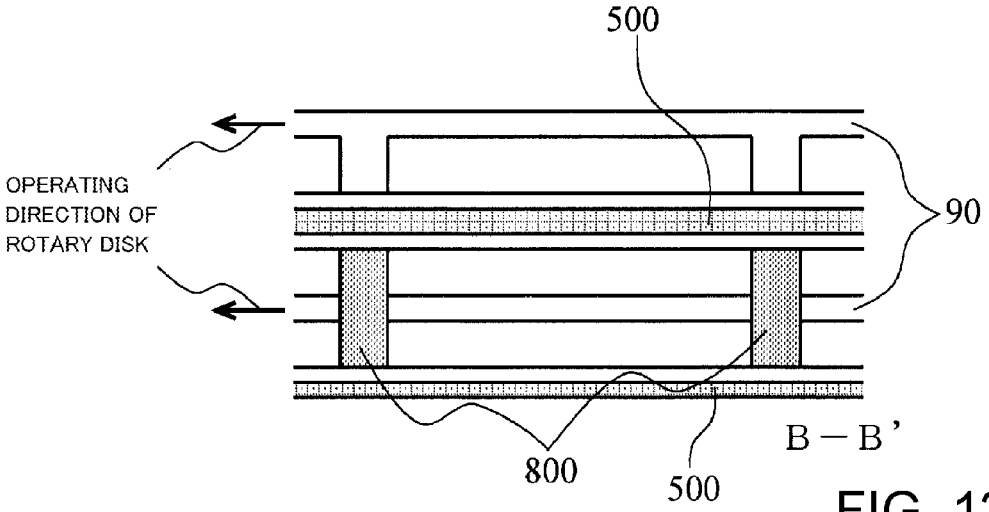
FIG. 12 is an enlarged view for illustrating each of rotary disks according to the still other embodiment of the present invention.

FIG. 12 is a cross-sectional view (cross-sectional view when the shaft 7 is viewed from the casing 2) along the line B-B' in FIG. 11.

Note that, in the third embodiment, by way of example, an example in which stationary disks (without grooves) 500 in which no spiral groove portion is formed are disposed in the Siegbahn type molecular pump 120 will be described.

As shown in MG. 11, in the Siegbahn type molecular pump 120 according to the third embodiment, grooved rotary disks 90 each formed with the spiral groove portions 93 each including a rotary-disk valley part 91 and a rotary-disk ridge portion 92 are disposed. In addition, projecting portions 800 are formed on an outer peripheral side of each of the grooved rotary disks 90 where the spiral groove portions 93 are not formed.

As shown in FIG. 12, each of the projecting portions 800 is formed in a state generally perpendicular to the movement direction of each of the grooved rotary disks 90 to project from the grooved rotary disk 90 in an outer peripheral direction (in FIG. 11, in a direction from the grooved rotary disk 90 toward the casing 2).

Figure 13:
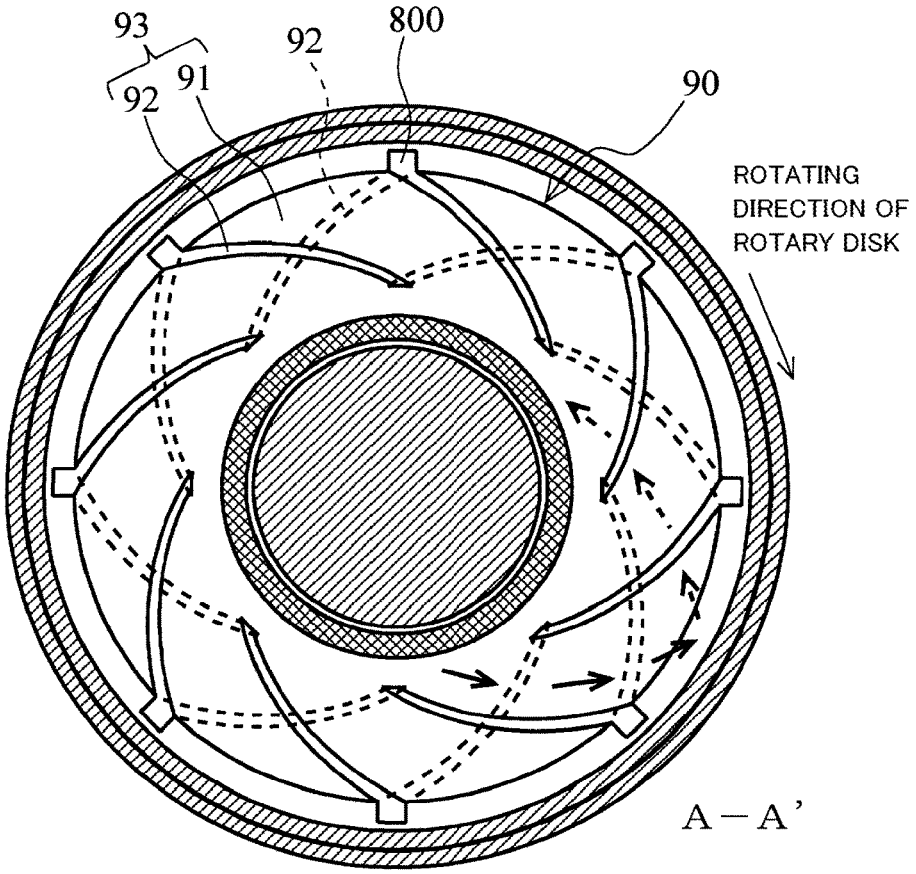
FIG. 13 is a view for illustrating the rotary disk according to the still other embodiment of the present invention.

FIG. 13 is a view for illustrating each of the grooved rotary disks 90 according to the third embodiment, which is a cross-sectional view when the grooved rotary disk 90 is viewed from the inlet port 4 in the A-A' direction in FIG. 11. In the drawing, the spiral groove portions closer to the outlet port 6 (on the downstream side) are shown by the broken lines.

In the drawing, the solid-line arrows shown in the grooved rotary disk 90 show parts of a gas flow in the spiral groove portions 93 formed in an upstream surface (closer to the inlet port 4) of the grooved rotary disk 90. Likewise, the broken-line arrows shown in the grooved rotary disk 90 show parts of a gas flow in the spiral groove portions 93 formed in a downstream surface (closer to the outlet port 6) of the grooved rotary disk 90.

In the third embodiment, the phase of the rotary-disk ridge portions 92 formed in the upper surface of the grooved rotary disk 90 matches the phase of the rotary-disk ridge portions 92 formed in the lower surface thereof and the projecting portions 800 and the rotary-disk ridge portions 92 are formed continuously in an integral configuration.

More specifically, the grooved rotary disk 90 is configured in a state where three portions which are the rotary-disk ridge portion 92 (solid line in FIG. 13) formed in the upstream surface (surface closer to the inlet port 4) of the grooved rotary disk 90, the projecting portion 800, and the rotary-disk ridge portion 92 (broken line in FIG. 13) formed in the downstream surface (surface closer to the outlet port 6) of the grooved rotary disk 90 are indiscretely connected. In other words, the grooved rotary disk 90 is configured such that the spiral groove portions 93 formed in the upper surface of the grooved rotary disk 90 have the same phase as that of the spiral groove portions 93 formed in the lower surface thereof and, at the outer-diameter end of the grooved rotary disk 90, the respective rotary-disk ridge portions 92 in the upper and lower surfaces are located at the same positions with the grooved rotary disk 90 being interposed therebetween. The projecting portions 800 are formed to project in an outer-diameter direction so as to connect, at the outer-diameter end of the grooved rotary disk 90, respective outer-diameter end portions of the upper and lower rotary-disk ridge portions 92 with the grooved rotary disk 90 being interposed therebetween.

Due to this configuration, in the Siegbahn type molecular pump 120 having the grooved rotary disk 90 according to the third embodiment, the flow paths formed between the projecting portions 800 are continuously connected to the flow paths formed between the rotary-disk ridge portions 92. As a result, the "momentum dominant in the exhaust direction" that has been given to the gas by the upstream spiral groove portions 93 (closer to the inlet port 4) is less likely to be lost and can be prevented from being dissipated.

(ii-5-1) Modification of Third Embodiment

The third embodiment described above is configured such that the respective phases of the spiral groove portions 93 (rotary-disk ridge portions 92) formed in the upper and lower surfaces of the grooved rotary disk 90 match each other and the projecting portions 800 and the respective end surfaces (outer-diameter end surfaces) of the rotary-disk ridge portions 92 in the upper and lower surfaces are continuously and integrally formed. However, the configuration of the third embodiment is not limited thereto.

Figure 14:
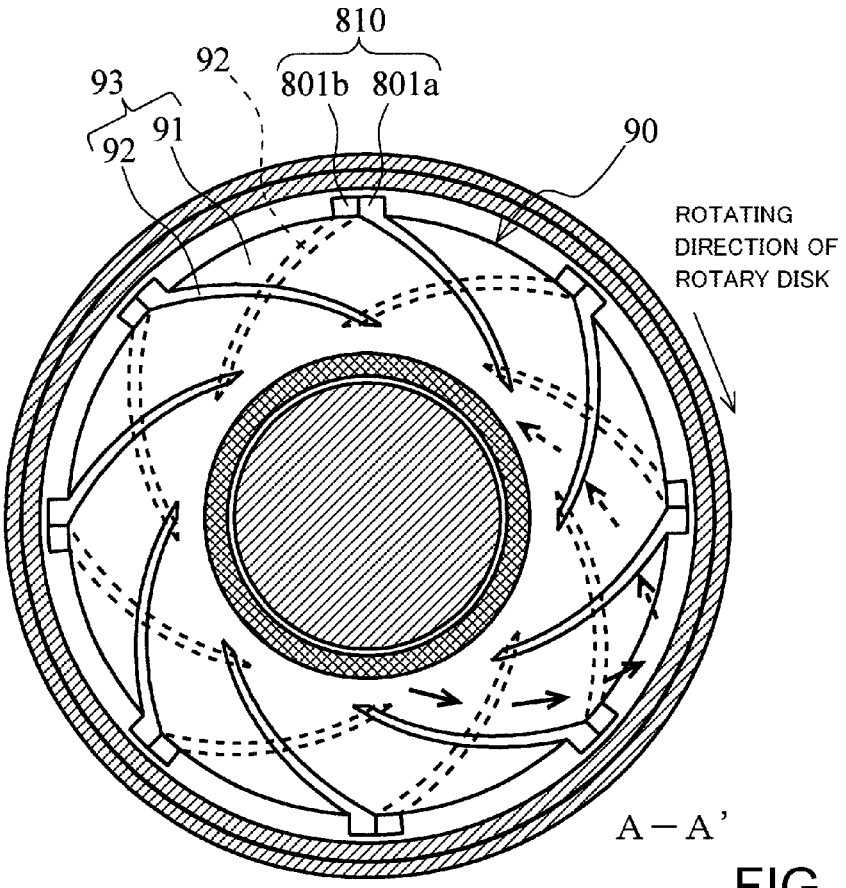
FIG. 14 is a view for illustrating the rotary disk according to the still other embodiment of the present invention.

FIG. 14 is a view for illustrating each of the grooved rotary disks 90 according to a modification of the third embodiment, which is a cross-sectional view when the grooved rotary disk 90 is viewed from the inlet port 4 in the A-A' direction in FIG. 11. In the drawing, the rotary-disk ridge portions 92 (spiral groove portions 93) closer to the outlet port 6 (on the downstream side) are shown by the broken lines.

Figure 15:
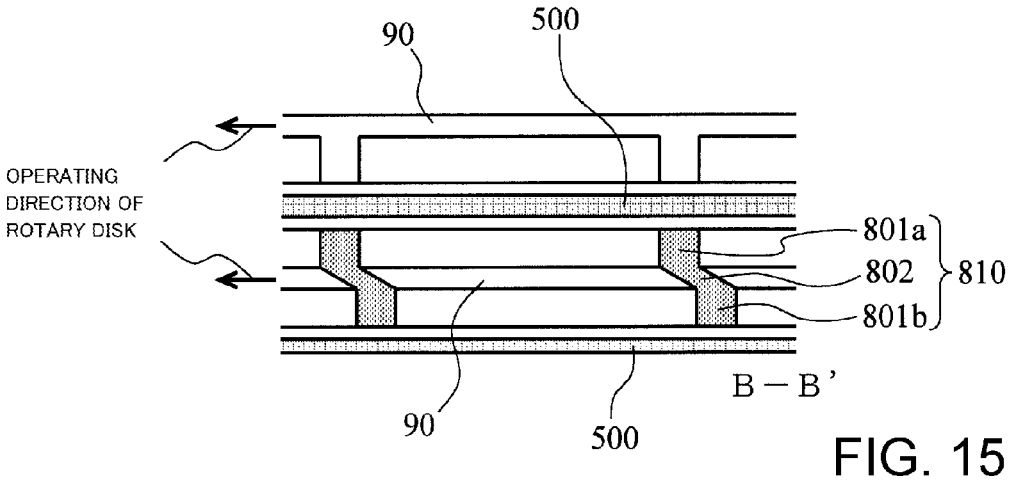
FIG. 15 is a view for illustrating the rotary disk according to the still other embodiment of the present invention.

FIG. 15 is a view for illustrating the grooved rotary disks 90 according to the modification of the third embodiment, which is a cross-sectional view (cross-sectional view when the casing 2 is viewed from the shaft 7) along the line B-B' in FIG. 11. On the grooved rotary disks 90, projecting portions 810 each disposed at an angle generally perpendicular to a movement direction of each of the grooved rotary disks 90 are formed to project from the grooved rotary disks 90 in an outer peripheral direction (in FIG. 11, in a direction from an outer peripheral side surface of the grooved rotary disk 90 toward the casing 2).

As shown in FIG. 14, in the modification of the third embodiment, the spiral groove portions 93 engraved in the grooved rotary disk 90 are configured such that the phase of the spiral groove portions 93 in the upper surface (shown by the solid lines) does not match the phase of the spiral groove portions 93 in the lower surface (shown by the broken lines) and the positions of the upper rotary-disk ridge portions 92 do not correspond to (are displaced from) the positions of the lower rotary-disk ridge portions 92 at the outer-diameter end surface of the grooved rotary disk 90.

In this case, the configuration is preferably such that the rotary-disk ridge portions 92 (solid lines) formed in the upstream surface of the grooved rotary disk 90, the upstream end portions of the projecting portions 810, the rotary-disk ridge portions 92 (broken lines) formed in the downstream surface of the grooved rotary disk 90, and the downstream end portions of the projecting portions 810 are formed continuously. That is, each of the projecting portions 810 is configured such that a predetermined angle is formed between at least a part thereof and the axial direction of the Siegbahn type molecular pump 120.

Next, referring to FIGS. 14 and 15, a description will be given of the predetermined angle.

In the modification of the third embodiment, as shown in FIG. 14, the rotary-disk ridge portions 92 of the spiral groove portions 93 formed in the upper and lower surfaces of the grooved rotary disk 90 are formed at positions which are different on the upper surface (shown by the solid lines) and on the lower surface (shown by the broken lines) (i.e., positions different above and below the grooved rotary disk 90 interposed therebetween when viewed in cross section).

In the modification of the third embodiment, the projecting portions 810 are formed on the grooved rotary disk 90 as follows.

The rotary-disk ridge portions 92 (solid lines) formed in the upstream surface of the grooved rotary disk 90 and extended portions 801*a* obtained by extending upstream end portions of the projecting portions 810 (or by extending upstream outer-diameter end portions of the rotary-disk ridge portions 92) and the rotary-disk ridge portions 92 (broken line) formed in the downstream surface of the grooved rotary disk 90 and extended portions 8011 obtained by extending downstream end portions of the projecting portions 810 (or by extending downstream outer-diameter end portions of the rotary-disk ridge portions 92) are formed continuously via inclined portions 802.

Due to the configuration, in each of the projecting portions 810 including the extended portion 801*a*, the inclined portion 802, and the extended portion 801*b*, a predetermined angle is formed between the inclined portion 802 and the axial direction of the Siegbahn type molecular pump 120.

More specifically, the projecting portions 810 are disposed stationary such that an outer-diameter side surface (surface where the spiral groove portions 93 are not formed) of the grooved rotary disk 90 in the axial direction which faces the spacer 60 via a space is formed with an inclined surface (inclined portion 802) projecting into the space and inclined in a downstream direction toward a direction in which the grooved rotary disk 90 rotates, while being spaced apart from the grooved rotary disk 90.

A specific description will be given of formation of the inclined portions 802.

First, on the outer-diameter side surface of the grooved rotary disk 90, the extended portions 801*a* are formed by extending end portions of the rotary-disk ridge portions 92 formed in an upstream region (surface closer to the inlet port 4) which are closer to an outer-diameter side of the grooved rotary disk 90 and the extended portions 801*b* are formed by extending end portions of the rotary-disk ridge portions 92 formed in a downstream region (surface closer to the outlet port 6) which are closer to the outer-diameter side of the grooved rotary disk 90. In the modification of the third embodiment, when the movement direction of each of the grooved rotary disks 90 is assumed to be a forward travelling direction as shown in FIG. 15, the extended portion 801*b* formed on the downstream surface of the grooved rotary disk 90 is disposed to be located rearward of the extended portion 801*a* formed on the upstream surface of the grooved rotary disk 90.

Then, each of the inclined portions 802 is provided so as to form an angle (depression angle) facing downward from the surface (horizontal reference) where the extended portion 801*a* is in contact with the grooved rotary disk 90 toward the surface where the extended portion 801*b* is in contact with the grooved rotary disk 90.

Alternatively, each of the projecting portions 810 is formed by causing the extended portions 801*a* and 801*b* to be joined together such that a predetermined angle (elevation angle) facing upward from the extended portion 801*b* toward the extended portion 801*a* is formed. Of the projecting portion 810, a covering/joined portion corresponds to the inclined portion 802.

Thus, the projecting portions 810 each including the extended portion 801*a*, the inclined portion 802, and the extended portion 801*b* are formed on the outer peripheral side surface of the grooved rotary disk 90.

In the modification of the third embodiment described above, the inclined portion 802 of each of the projecting portions 810 is configured to be inclined in the exhaust direction of the Siegbahn type molecular pump 120.

In the configuration described above, on the outer-diameter side of the grooved rotary disk 90 serving as the flow paths (outer-diameter-side bent flow paths) in the axial direction of the Siegbahn type molecular pump 120 described above, the grooved rotary disk 90 includes the projecting portions 810 each projecting from the outer-diameter side surface of the grooved rotary disk 90 and having the inclined portion 802. Due to this configuration, in the modification of the third embodiment, gas molecules enter a downstream surface (surface facing the outlet port 6) of the inclined portion 802 of each of the projecting portions 810 preferentially to an upstream surface (surface facing the inlet port 4) thereof.

Since the inclined portion 802 is inclined at the angle (depression angle) facing downward relative to the grooved rotary disk 90 serving as the horizontal reference, the gas molecules are reflected preferentially downstream. This results in the probability of downstream diffusion higher than the probability of reverse diffusion to produce the exhausting function in the outer-diameter-side bent flow paths of the Siegbahn type molecular pump 120.

Thus, in the modification of the third embodiment, it is possible to prevent the momentum that has been given to the gas molecules by the Siegbahn type exhaust mechanism of the Siegbahn type molecular pump 120 in the outer-diameter-side bent flow paths to be dominant in the exhaust direction from being dissipated and also produce a drag effect in each of the bent portions. This can minimize a loss in the inner-diameter-side bent flow path.

Alternatively, the configuration may also be such that the phase of the rotary-disk ridge portions 92 (solid lines) of the spiral groove portions 93 formed in the upper surface of the grooved rotary disk 90 does not match the phase of the rotary-disk ridge portions 92 (broken lines) of the spiral groove portions 93 formed in the lower surface thereof and the projecting portions 800 are formed in parallel with the axial direction of the Siegbahn type molecular pump 120, though not shown. That is, in the configuration, no inclined portion is formed.

In this case, the projecting portions 800 are configured to be formed to project from an outer peripheral surface of the grooved rotation disk 90 in any of the states where the rotary-disk ridge portions 92 (solid lines) formed in the upstream surface of the grooved rotary disk 90 are continued to the upstream outer-diameter end portions of the projecting portions 800, where the rotary-disk ridge portions 92 (broken lines) formed in the downstream surface of the grooved rotary disk 90 are continued to the downstream outer-diameter end portions of the projecting portions 800, and where neither the upstream outer-diameter end portions of the projecting portions 800 nor the downstream outer-diameter end portions thereof are continued from the rotary-disk ridge portions 92.

(ii-6) Fourth Embodiment

Next, a description will be given of a Siegbahn type molecular pump 130 in which the rotary cylinder 10 is disposed through the grooved rotary disks 90 and projecting portions 900 and junction portions 901 are formed in the rotary cylinder 10.

More specifically, on an inner peripheral side of each of the grooved rotary disks 90 having the spiral groove portions 93, the rotary cylinder 10 is disposed to be concentric to the grooved rotary disk 90 and the projecting portions 900 and the junction portions 901 are formed on the outer peripheral side surface of the rotary cylinder 10.

Note that, in the fourth embodiment, by way of example, a description will be given on the assumption that stationary disks disposed in the Siegbahn type molecular pump 130 are the stationary disks 500 in which no spiral groove is formed.

Figure 16:
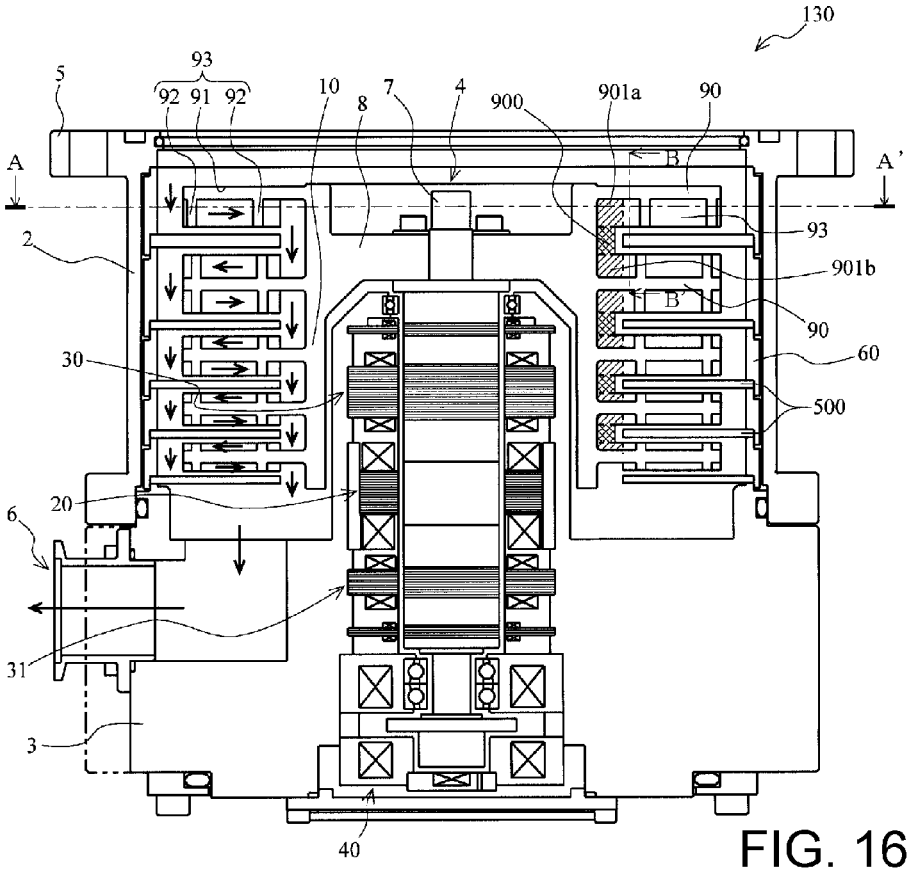
FIG. 16 is a view showing an example of a schematic configuration of a Siegbahn type molecular pump according to a yet another embodiment of the present invention.

FIG. 16 is a view showing an example of a schematic configuration of the Siegbahn type molecular pump 130 according to the fourth embodiment. Note that, for the same components as in FIG. 1, reference numerals and a description thereof are omitted.

Figure 17:
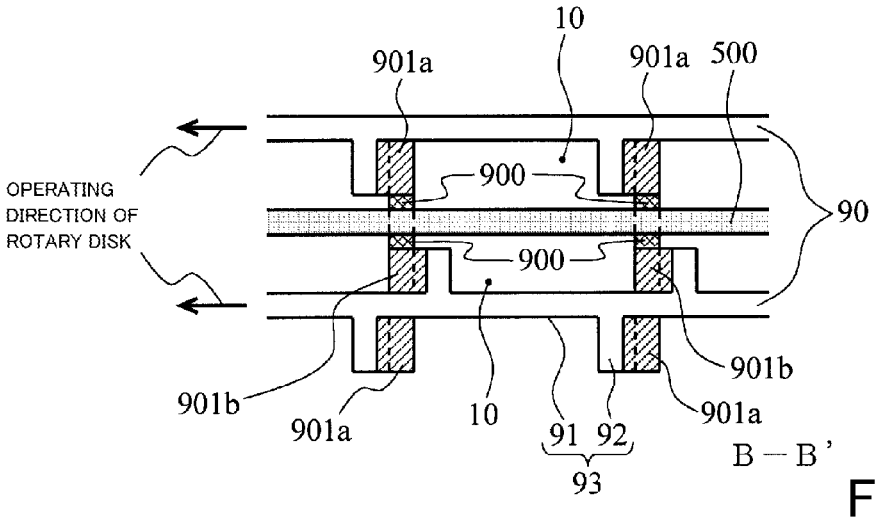
FIG. 17 is an enlarged view for illustrating each of rotary disks according to the yet other embodiment of the present invention.

FIG. 17 is a cross-sectional view (cross-sectional view when the shaft 7 is viewed from the casing 2) along the line B-B' in FIG. 16.

Figure 18:
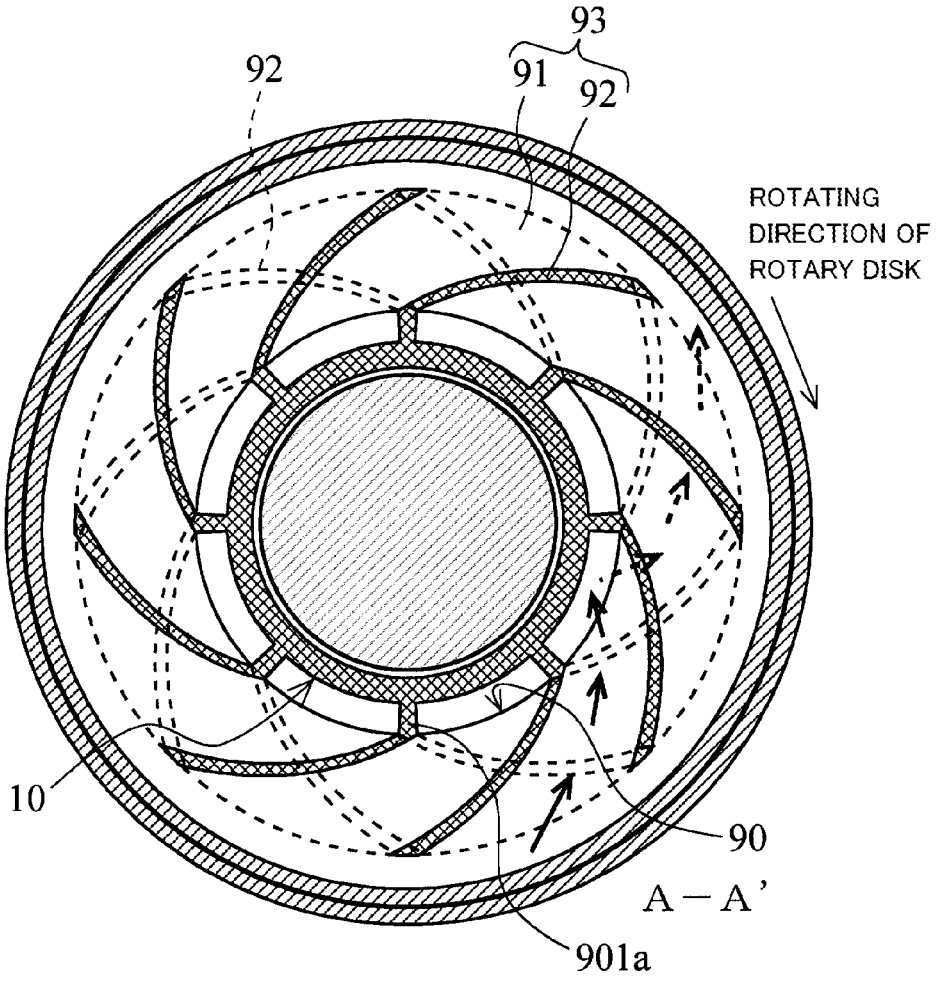
FIG. 18 is a view for illustrating the rotary disk according to the yet other embodiment of the present invention.

FIG. 18 is a view for illustrating each of the grooved rotary disks 90 and the rotary cylinder 10 according to the fourth embodiment, which is a cross-sectional view when the grooved rotary disk 90 and the rotary cylinder 10 are viewed from the inlet port 4 in the A-A' direction in FIG. 16. In the drawing, the rotary-disk ridge portions 92 (spiral groove portions 93) closer to the outlet port 6 (on the downstream side) are shown by the broken lines.

As shown in FIG. 16, the Siegbahn type molecular pump 130 according to the fourth embodiment has, on an outer peripheral surface of the rotary cylinder 10 disposed therein, the projecting portions 900 and also the junction portions 901 joining the rotary cylinder 10 to the grooved rotary disk 90.

More specifically, on the outer-diameter side surface of the rotary cylinder 10 which faces the stationary disks 500, the junctions portions 901 and the projecting portions 900 are provided to project toward the stationary disks 500.

As shown in FIGS. 16 and 17, each of the junction portions 901 includes a junction portion 901*a* and a junction portion 901*b*.

The junction portions 901*a* are configured by extending, toward the inner-diameter side, the side surfaces of the rotary-disk ridge portions 92 of those of the spiral groove portions 93 formed in the grooved rotary disk 90 disposed on the upstream side (closer to the inlet port 4) which are closer to the outlet port 6 (i.e., inner peripheral end portion of the grooved rotary disk 90). In the Siegbahn type molecular pump 130 (Siegbahn type exhaust mechanism), the plurality of grooved rotary disks 90 are arranged to face each other via gaps and the stationary disks 500. The junction portions 901*a* are in contact with (fixed to) not only the rotary cylinder 10, but also the rotary-disk valley parts 91 of the one of the plurality of grooved rotary disks 90 disposed on the downstream side which are formed closer to the outlet port 6.

The junction portion 901*b* is configured by extending, toward the inner-diameter side, the side surfaces of the rotary-disk ridge portions 92 on a side of the inlet port 4 (i.e., inner peripheral end portion of the grooved rotary disk 90), of those of the spiral groove portions 93 formed in the grooved rotary disk 90 disposed on the downstream side (closer to the outlet port 6). The junction portions 901*b* are in contact with (fixed to) not only the rotary cylinder 10, but also the rotary-disk valley parts 91 of the one of the plurality of similarly arranged grooved rotary disks 90 disposed on the upstream side which are formed closer to the inlet port 4.

The projecting portions 900 are provided at positions on the outer-diameter side surface of the rotary cylinder 10 where the rotary cylinder 10 and the stationary disks 500 face each other and joined to the junction portions 901*a* and 901*b* described above.

As also shown in FIGS. 17 and 18, the projecting portions 900 and the junction portions 901 which are disposed at angles generally perpendicular to the movement direction of each of the grooved rotary disks 90 are formed to project from the rotary cylinder 10 in an outer peripheral direction (in FIG. 16, in a direction from the outer peripheral side surface of the rotary cylinder 10 toward the casing 2).

Thus, in the fourth embodiment, the flow paths upstream of the stationary disks 500 and the flow paths downstream thereof are connected by the projecting portions 900 and the junction portions 901. That is, the projecting portions 900 and the junction portions 901 are formed on the rotary cylinder 10 to provide a structure in which an upstream region of the Siegbahn type molecular pump and a downstream region of the Siegbahn type molecular pump each having the exhausting function (i.e., having a spiral groove structure) are continued to each other in a form which does not interrupt the exhausting function.

As a result, gas molecules flowing in the region of the Siegbahn type exhaust mechanism of the Siegbahn type molecular pump 130 pass as inwardly bent flow paths through a space where the projecting portions 900 and the junction portions 901 each formed on the rotary cylinder 10 are present in a region around the outer peripheral side surface of the rotary cylinder 10, particularly in a spatial area (gap) formed by the outer peripheral side surface of the rotary cylinder 10 and the inner-diameter side surface of the stationary disk 500 which face each other.

Due to this configuration, in the fourth embodiment, the "momentum dominant in the exhaust direction" that has been given to the gas by the exhaust flow paths (spiral groove portions 93) in the radial direction of the upstream Siegbahn type exhaust mechanism (closer to the inlet port 4) is less likely to be lost and prevented from being dissipated.

Also, as shown in FIG. 18, the fourth embodiment described above is configured such that each of the number of the projecting portions 900 and the number of the junction portions 901 which are disposed on the rotary cylinder 10 is the same as the number of the peaks (rotary-disk ridge portions 92) of the spiral groove portions 93 engraved in each of the grooved rotary disks 90. However, the respective numbers of the projecting portions 900, the junction portions 901, and the rotary-disk ridge portions 92 are not limited thereto.

As has been described in Modification 1 of each of the first/second embodiments, each of the disposition number of the projecting portions 900 and the disposition number of the junction portions 901 may appropriately be an integral multiple of the disposition number of the rotary-disk ridge portions 92.

Alternatively, as has been described in Modification 2 of each of the first/second embodiments, the disposition number of the rotary-disk ridge portions 92 may also be an integral multiple of each of the disposition number of the projecting portions 900 and the disposition number of the junction portions 901.

(ii-6-1) Modification of Fourth Embodiment

Next, a description will be given of a form as a modification of the fourth embodiment in which the respective phases of the projecting portions 901 (901*a* and 901*b*) formed individually in the respective facing side surfaces of the grooved rotary disks 90 facing each other do not match and, on the rotary cylinder 10 disposed in the Siegbahn type molecular pump 130, inclined projecting portions 910 are disposed such that a predetermined angle is formed between each of the inclined projecting portions 910 and the axial direction of the Siegbahn type molecular pump 130 (i.e., in an oblique state).

Figure 19:
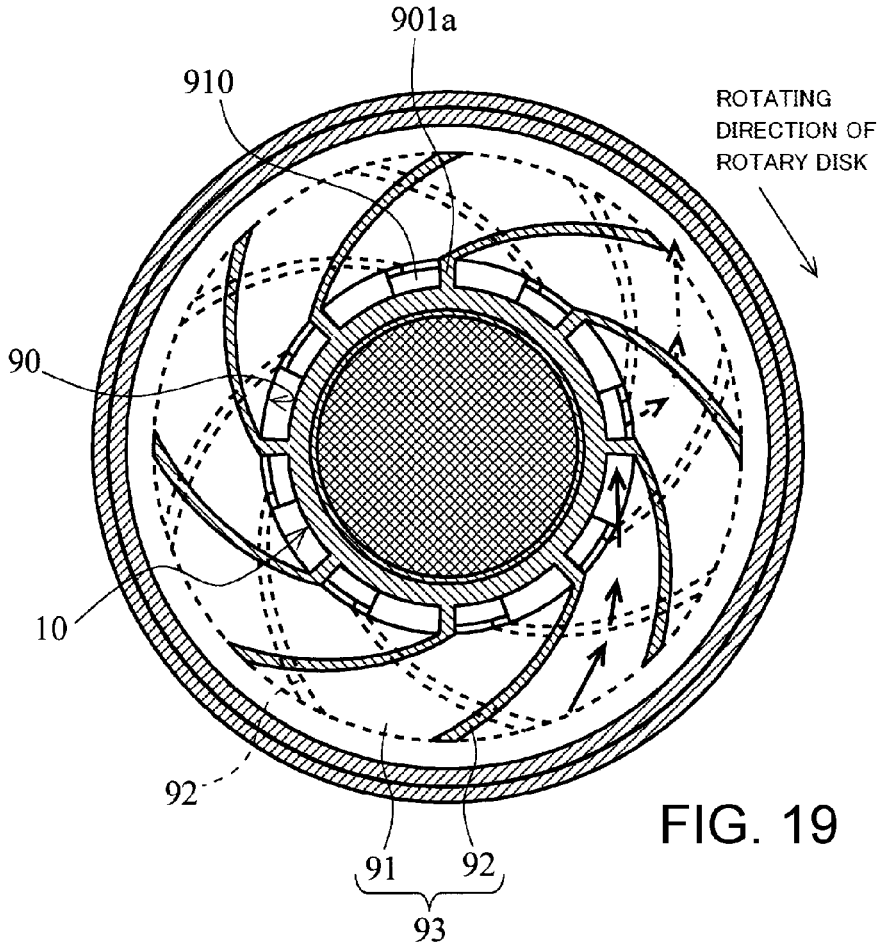
FIG. 19 is a view for illustrating the rotary disk according to the yet other embodiment of the present invention.

FIG. 19 is a cross-sectional view for illustrating the grooved rotary disk 90 and the rotary cylinder 10 according to the modification of the fourth embodiment. In the drawing, spiral groove portions (rotary-disk ridge portions 92) closer to the outlet port 6 (on the downstream side) are shown by the broken lines.

Figure 20:
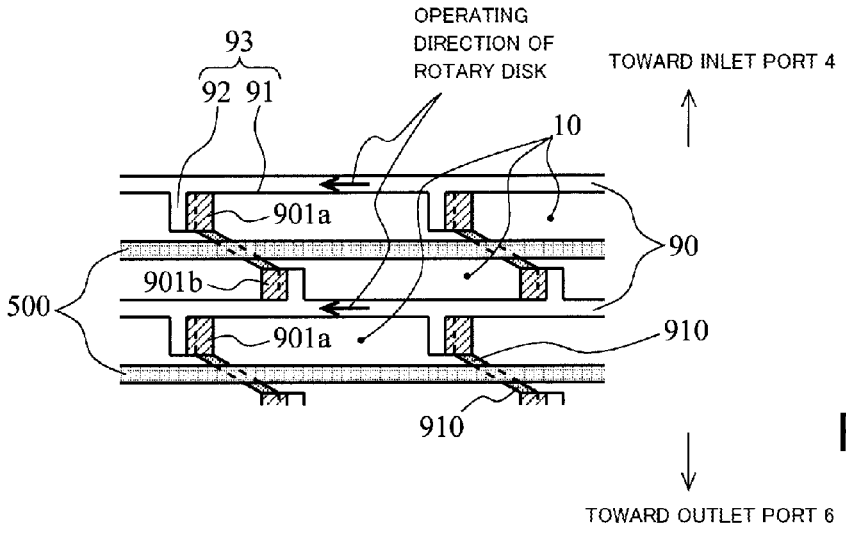
FIG. 20 is an enlarged view for illustrating the rotary disk according to the yet other embodiment of the present invention.

FIG. 20 is a cross-sectional view at the same position as in FIG. 17, which is a view for illustrating the grooved rotary disks 90 and the rotary cylinder 10 according to the modification of the fourth embodiment.

In the modification of the fourth embodiment, as shown in FIG. 19, the phases of the rotary-disk ridge portions 92 of the spiral groove portions 93 formed in the upper and lower facing surfaces of the rotary disks 90 facing each other do not match (are shifted from each other) in the inner-diameter-side bent flow paths. That is, the rotary-disk ridge portions 92 formed in the upstream surface (shown by the solid lines) and the rotary-disk ridge portions 92 formed in the downstream surface (shown by the broken lines) are at different positions (i.e., at different upper and lower positions with the grooved rotary disk 90 being interposed therebetween when viewed in cross section).

In the modification of the fourth embodiment, as shown in FIG. 20, the junction portions 901*a* formed in the rotary-disk valley parts 91 of the spiral groove portions 93 engraved in the downstream surface (closer to the outlet port 6) of the one of the plurality of grooved rotary disks 90 which is formed closer to the inlet port 4 are formed rearward of the rotary-disk ridge portions 92 in the movement direction of each of the grooved rotary disks 90.

On the other hand, the junction portions 901*b* formed in the rotary-disk valley parts 91 of the spiral groove portions 93 engraved in the upstream surface (closer to the inlet port 4) of the grooved rotary disk 90 facing the grooved rotary disk 90 formed with the junction portions 901*a* via a gap and located closer to the outlet port 6 are formed forward of the rotary-disk ridge portions 92 in the movement direction of each of the grooved rotary disks 90.

The inclined projecting portions 910 are formed on the rotary cylinder 10 so as to extend from the junction portions 901*a* toward the junction portions 901*h*. Due to this configuration, each of the inclined projecting portions 910 provided to project from the rotary cylinder 10 is configured such that the predetermined angle is formed between the inclined projecting portion 910 and the axial direction of the Siegbahn type molecular pump 130.

More specifically, each of the inclined projecting portions 910 has an angle (depression angle) facing downward from the junction portion 901*a* to the junction portion 901*b* relative to the stationary disk 500 serving as a horizontal reference.

That is, each of the inclined projecting portions 910 is configured to be inclined in the exhaust direction of the Siegbahn type molecular pump 130.

Due to this configuration, in the modification of the fourth embodiment, on the outer-diameter side of the rotary cylinder 10 serving as the flow paths (bent flow paths) in the axial direction of the Siegbahn type molecular pump 130, gas molecules enter a lower surface (surface facing the outlet port 6) of each of the inclined projecting portions 910 preferentially to an upper surface (surface facing the inlet port 4) thereof. This results in the probability of downstream diffusion higher than the probability of reverse diffusion to produce the exhausting function on the outer-diameter side of the rotary cylinder 10. Therefore, in the Siegbahn type molecular pump 130, it is possible to prevent the momentum that has been given to gas molecules by the Siegbahn type exhaust mechanism to be dominant in the exhaust direction from being dissipated and also produce a drag effect in each of the bent portions. This can minimize a loss in the inner-diameter-side bent flow path.

(ii-7) Fifth Embodiment

Next, a description will be given of a form in which, on an outer peripheral side of a stationary disk, projecting portions are formed on inner peripheral side surface of a stationary cylinder disposed to be concentric to the stationary disk.

Figure 21:
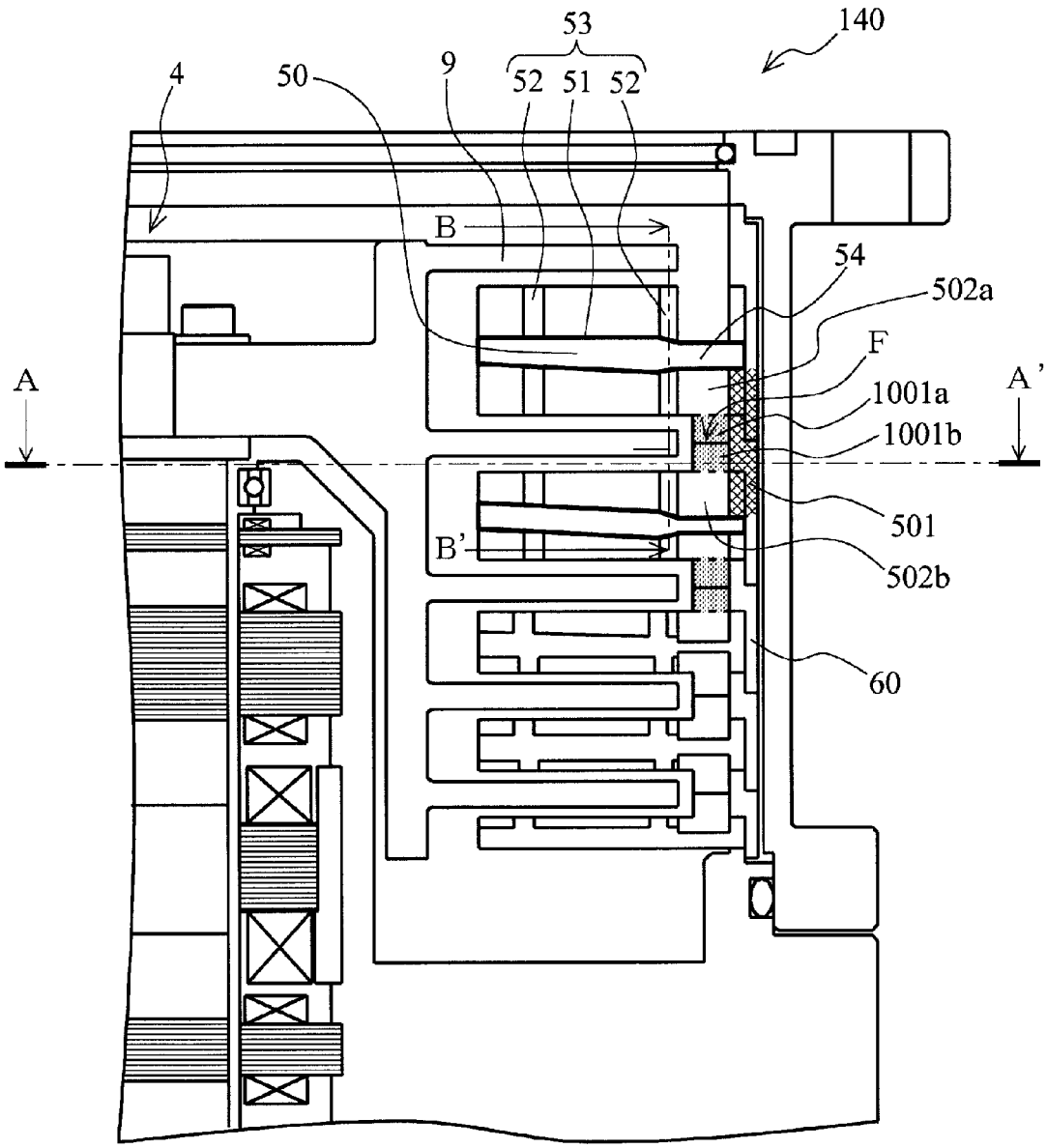
FIG. 21 is a view showing an example of a schematic configuration of a Siegbahn type molecular pump according to a still another embodiment of the present invention.

FIG. 21 is a view showing an example of a schematic configuration of a Siegbahn type molecular pump 140 according to the fifth embodiment. Note that, for the same components as in FIG. 1, reference numerals and a description are omitted.

Figure 22:
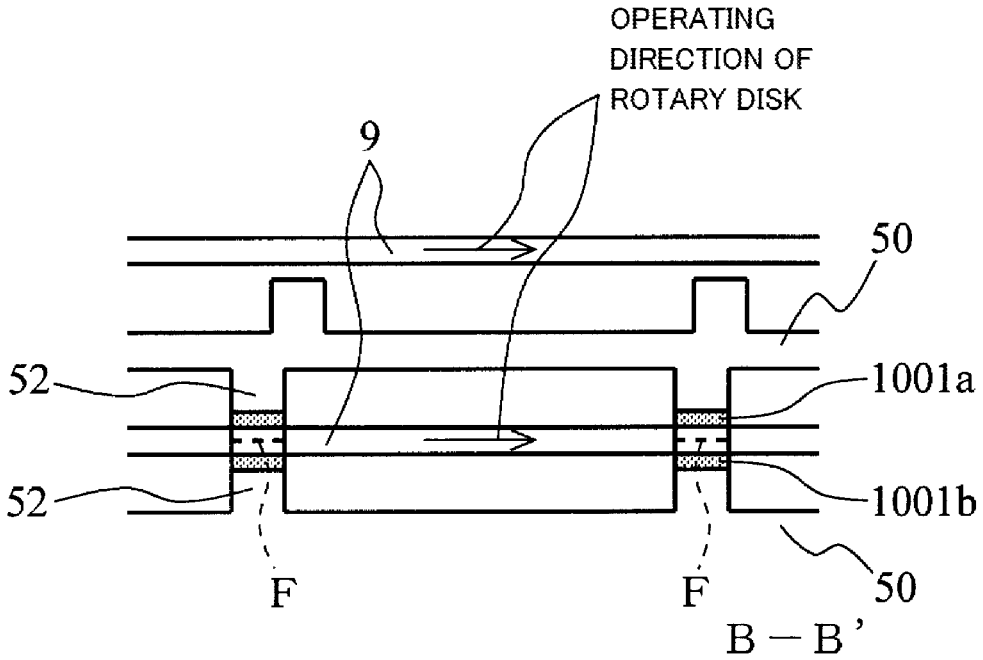
FIG. 22 is an enlarged view for illustrating each of stationary disks according to the still other embodiment of the present invention.

FIG. 22 is a cross-sectional view (cross-sectional view when the casing 2 is viewed from the shaft 7) along the line B-B' in FIG. 21.

Figure 23:
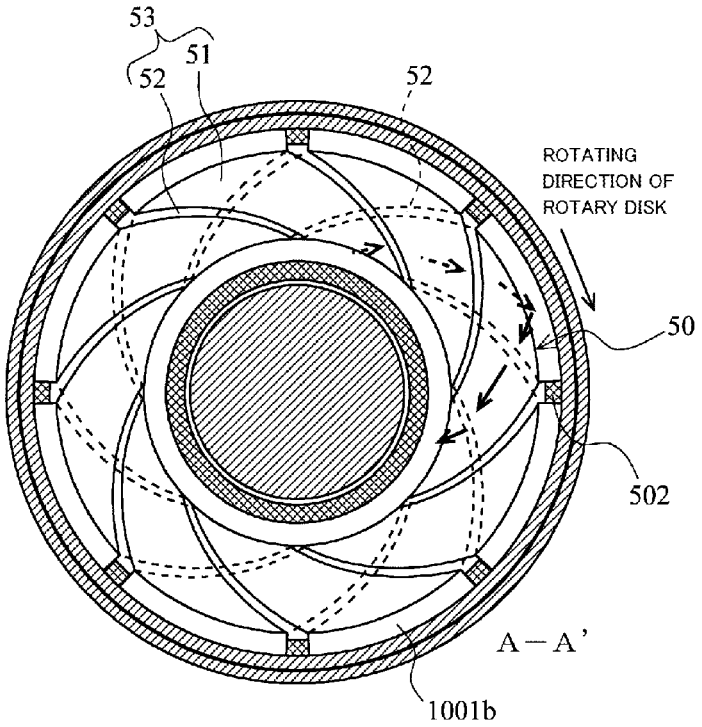
FIG. 23 is a view for illustrating the stationary disk according to the still other embodiment of the present invention.

FIG. 23 is a view for illustrating the stationary disk 50 according to the fifth embodiment, which is a cross sectional view when the stationary disk 50 is viewed from the side of the inlet port 4 in the A-A' direction in FIG. 21. In the drawing, the stationary-disk ridge portions 52 (spiral groove portions 53) closer to the outlet port 6 (on the downstream side) are shown by the broken lines.

As shown in FIG. 21, the Siegbahn type molecular pump 140 according to the fifth embodiment has the stationary disk 50 in which a stationary cylinder-shaped portion 501, extended portions 502 (extended portions 502*a* and 502*b*), and projecting portions 1001 (projecting portions 1001*a* and 1001*b*) are disposed.

The stationary cylinder-shaped portion 501 is a cylindrical component disposed stationary around the outer periphery of the stationary disk 50 to be concentric to the stationary disk 50.

The extended portions 502 are components disposed on the inner peripheral side surface of the stationary cylinder-shaped portion 501 to project in the center axis direction of the Siegbahn type molecular pump 140 and include the extended portions 502*a* disposed downstream of an outer-diameter portion 54 of the stationary disk 50 located closer to the inlet port 4 where the spiral groove portions 53 are not formed and the extended portions 502*h* disposed upstream of the outer-diameter portion 54 of the stationary disk 50 located closer to the outlet port 6 where the spiral groove portions 53 are not formed.

Each of the extended portions 502*a* has an upstream side thereof when disposed in the Siegbahn type molecular pump 140 which is joined to the outer-diameter portion 54, a side thereof closer to the casing 2 which is joined to the stationary cylinder-shaped portion 501, a side thereof closer to the center axis which is joined to the stationary-disk ridge portion 52, and a downstream side thereof which is joined to the projecting portion 1001*a*.

Each of the extended portions 502*b* has an upstream side thereof when disposed in the Siegbahn type molecular pump 140 which is joined to the projecting portion 1001), a side thereof closer to the casing 2 which is joined to the stationary cylinder-shaped portion 501, a side thereof closer to the center axis which is joined to the stationary-disk ridge portion 52, and a downstream side thereof which is joined to the outer-diameter portion 54.

The projecting portions 1001 are components disposed stationary on the inner peripheral side surface of the stationary cylinder-shaped portion 501 to project in the center axis direction of the Siegbahn type molecular pump 140. Each of the projecting portions 1001*a* is disposed on a surface of the extended portion 502*a* opposite to the surface thereof fixed to the outer-diameter portion 54 to have a size which provides a space between the projecting portion 1001*a* and the rotary disk 9 facing the projecting portion 1001*a* when the stationary disk 50 is disposed in the Siegbahn type molecular pump 140. Each of the projecting portions 1001*b* is disposed on a surface of the extended portion 502*b* opposite to the surface thereof fixed to the outer-diameter portion 54 to have a size which provides a space between the projecting portion 1001*b* and the rotary disk 9 facing the projecting portion 1001*b* when the stationary disk 50 is disposed in the Siegbahn type molecular pump 140.

Note that, in the fifth embodiment, as shown in FIGS. 21 and 22, the projecting portions 1001*a* and 1001*b* are closely connected with no gap at a junction portion (junction surface) F into the form of one plate. However, the configuration is not limited thereto. The projecting portions 1001*a* and 1001*b* may also be configured such that the respective facing surfaces of the projecting portions 1001*a* and 1001*b* have a gap therebetween.

Due to this configuration, in the fifth embodiment, it is possible to prevent the momentum that has been given to gas molecules by the Siegbahn type exhaust mechanism in the outer bent flow paths (flow paths in the axial direction of the Siegbahn type molecular pump 140) in the Siegbahn type molecular pump 140 so as to be dominant in the exhaust direction from being dissipated and produce a rotation drag effect. This allows exhaust continuity to be maintained even in the outer bent flow paths.

(ii-7-1) Modification of Fifth Embodiment

Figure 24:
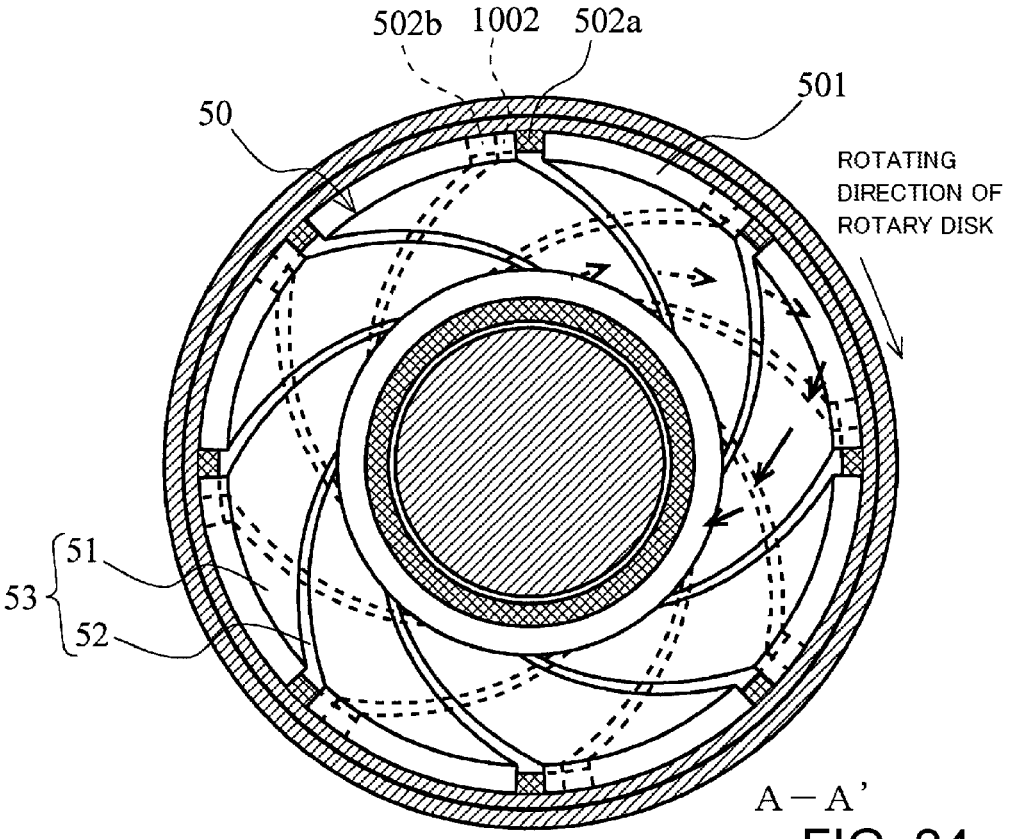
FIG. 24 is a view for illustrating the stationary disk according to the still other embodiment of the present invention.

FIG. 24 is a view for illustrating the stationary disk 50 according to a modification of the fifth embodiment, which is a cross-sectional view when the stationary disk 50 is viewed from the inlet port 4 in the A-A' direction in FIG. 21. In the drawing, the stationary-disk ridge portions 52 (spiral groove portions 53) closer to the outlet port 6 (on the downstream side) are shown by the broken lines.

Figure 25:
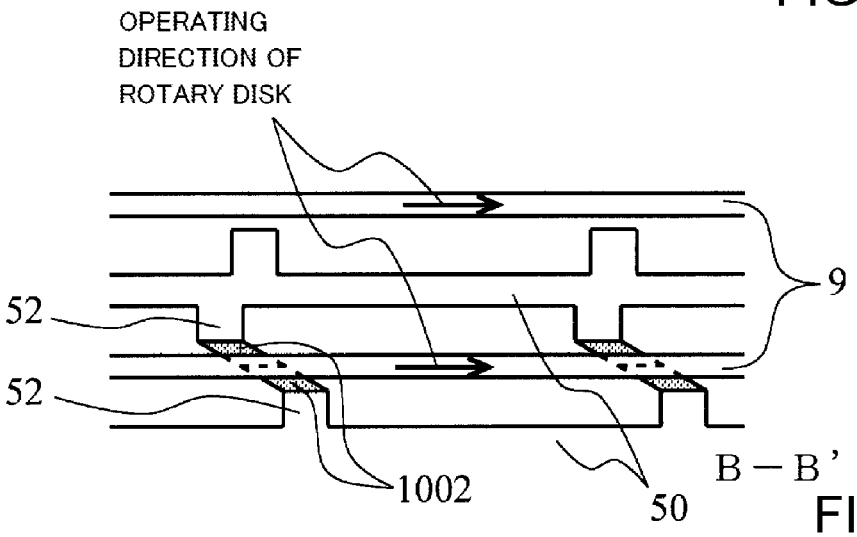
FIG. 25 is an enlarged view for illustrating the stationary disk according to the still other embodiment of the present invention.
Figure 26:
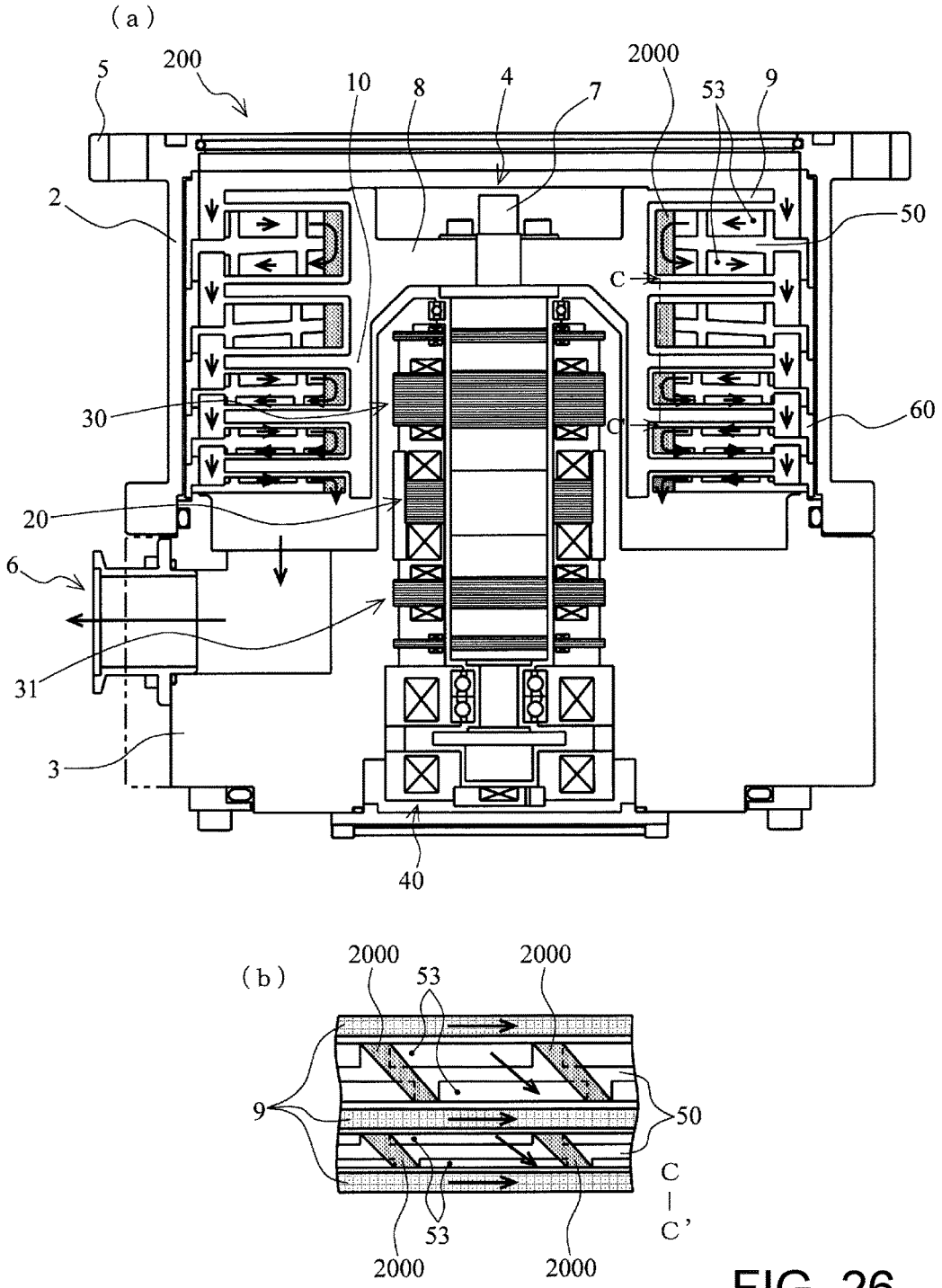
FIG. 26 is a view showing an example of a schematic configuration of a Siegbahn type molecular pump according to a yet another embodiment of the present invention.

FIG. 25 is a cross-sectional view (cross-sectional view when the casing 2 is viewed from the shaft 7) along the line B-B' in FIG. 21.

As shown in FIG. 25, in the modification of the fifth embodiment, the spiral groove portions 53 (shown by the solid lines) engraved in the upper surface of the stationary disk 50 have a phase which does not match the phase of the spiral groove portions 53 (shown by the broken lines) engraved in the lower surface thereof. This results in a configuration in which the respective positions of the upper and lower stationary-disk valley parts 52 at the outer-diameter end surfaces of the stationary disks 50 do not correspond to (are displaced from) each other.

In this case, the configuration is preferably such that the extended portion 502*a* formed on the outer-diameter portion 54 of the upstream stationary disk 50, an inclined portion 1002, and the extended portion 502*b* formed on the outer-diameter portion 54 of the downstream stationary disk 50 are continuously formed. That is, the inclined portion 1002 has a configuration in which a predetermined angle is formed between the inclined portion 1002 and the axial direction of the Siegbahn type molecular pump 140.

Next, referring to FIG. 25, a description will be given of the predetermined angle.

In the modification of the fifth embodiment, as shown in FIG. 25, when the movement direction of each of the rotary disks 9 is assumed to be a forward travelling direction, the stationary-disk ridge portion 52 (extended portion 502*b*) formed in the upstream surface of the stationary disk 50 is disposed forward of the stationary-disk ridge portion 52 (extended portion 502*a*) formed in the downstream surface of the stationary disk 50.

Each of the projecting portions 1002 is provided such that a predetermined angle (depression angle) facing downward from the surface (horizontal reference) where the extended portion 502*a* is in contact with the projecting portion 1002 toward the surface where the extended portion 502*b* is in contact with the projecting portion 1002 is formed.

Alternatively, the projecting portion 1002 is provided such that a predetermined angle (elevation angle) facing upward from the surface (horizontal reference) where the extended portion 502*b* is in contact with the projecting portion 1002 toward the surface where the extended portion 502*a* is in contact with the projecting portion 1002 is formed.

In the modification of the fifth embodiment thus configured, the inclined portion 1002 is configured to be inclined in the exhaust direction of the Siegbahn type molecular pump 140.

Due to the configuration of the modification of the fifth embodiment described above, gas molecules enter a downstream surface (surface facing the outlet port 6) of each of the inclined portions 1002 preferentially to an upstream surface (surface facing the inlet port 4) thereof.

Since the inclined portion 1002 is inclined at the downward angle (depression angle) relative to the surface serving as the horizontal reference where the extended portion 502*a* is in contact with the projecting portion 1002, gas molecules are reflected preferentially downstream. This results in the probability of downstream diffusion higher than the probability of reverse diffusion to produce the exhausting function in the outer-diameter-side bent flow paths of the Siegbahn type molecular pump 140.

Thus, in the modification of the fifth embodiment, it is possible to prevent the momentum that has been given to gas molecules by the Siegbahn type exhaust mechanism of the Siegbahn type molecular pump 140 in the outer-diameter-side bent flow paths so as to be dominant in the exhaust direction from being dissipated and also produce a drag effect in each of the bent portions. This can minimize a loss in the inner-diameter-side bent flow paths.

(ii-8) Sixth Embodiment

FIGS. 26A and 26B are views for illustrating a Siegbahn type molecular pump 200 according to a sixth embodiment of the present invention. FIG. 26A is a cross-sectional view in an axial direction. Note that the same components as in FIG. 1 are designated by the same reference numerals and a description thereof is omitted. FIG. 26B is a cross-sectional view (cross-sectional view when the casing 2 is viewed from the shaft 7) along the line C-C' in FIG. 26A.

In the sixth embodiment of the present invention, each of projecting portions (which are projecting portions 2000 in FIGS. 26A and 26B) formed in a vacuum pump component (which is the stationary disk 50 in FIG. 26) having spiral groove portions and disposed in the Siegbahn type molecular pump 200 is configured of a plate-like member separate from the stationary disk 50.

Note that, referring to FIG. 1, a description will be given of a projection amount P of each of the projecting portions (protruding portions) in each of the embodiments and the modifications.

In each of the embodiments and the modifications described above, by way of example, each of the projecting portions (protruding portions) is configured to be disposed to have a size such that the projection amount P thereof is not less than 70% of a depth S of the portion of the spiral groove (which is the spiral groove portion 53 in FIG. 1) which is proximate to the projecting portion (protruding portion).

Similarly referring to FIG. 1, a description will be given of a distance W between a first component (vacuum pump component having spiral groove portions) having the projecting portions (protruding portions) and a second component included together with the first component in the Siegbahn type exhaust mechanism.

In each of the embodiments and the modifications described above, by way of example, the first and second components are configured to be disposed such that the distance W therebetween has a dimension of not more than 2 mm.

(ii-9) Modification of Each of Embodiments

Figure 27:
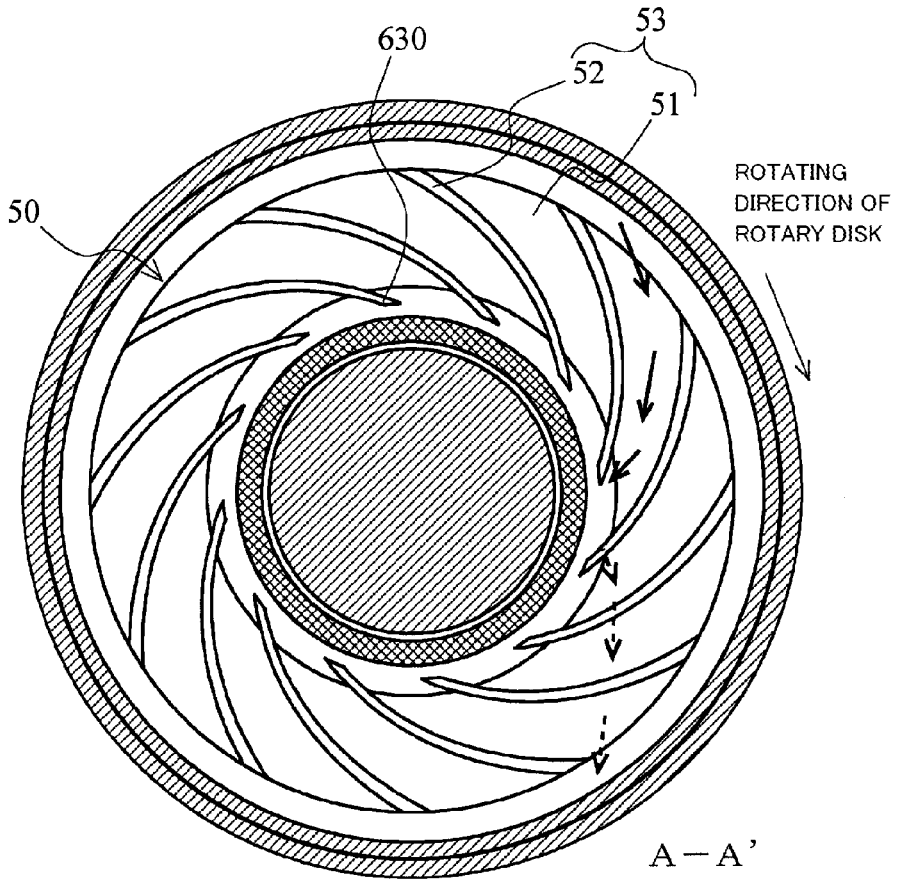
FIG. 27 is a view for illustrating each of the stationary disks according to each of the embodiments of the present invention.

FIG. 27 is a view for illustrating a modification of each of the embodiments described above, which is a cross-sectional view when the stationary disk 50 is viewed from the inlet port 4 in the A-A' direction in each of the drawings showing the example of the schematic configuration.

Note that, in FIG. 27, by way of example, a description will be given using the stationary disk 50.

In the drawing, the stationary-disk ridge portions 52 closer to the outlet port 6 (on the downstream side) are shown by the broken lines.

In the modification of each of the embodiments of the present invention, the shapes of the projecting portions (protruding portions) are different from those in each of the embodiments described above.

As shown in FIG. 27, each of the projecting portions (protruding portions) according to each of the embodiments of the present invention may also be configured of a projecting portion 630 formed of an end portion of the stationary-disk ridge portion 52 that has been extended in an inner-diameter-side extending direction.

The projecting portions 630 are different from the projecting portions in each of the embodiments described above in that there is no bent portion at the boundaries between the projecting portions 630 and the stationary-disk ridge portions 52 engraved in the stationary disk 50 and the projecting portions 630 have shapes formed of curves extended from the curves forming the stationary-disk ridge portions 52.

The stationary-disk ridge portions 52 used herein indicate parts where a drag effect is to be exerted by the rotary disk 9 and the stationary disk 50. The projecting portions (protruding portions) according to each of the embodiments of the present invention indicate extended portions where the drag effect is not to be exerted.

Figure 28:
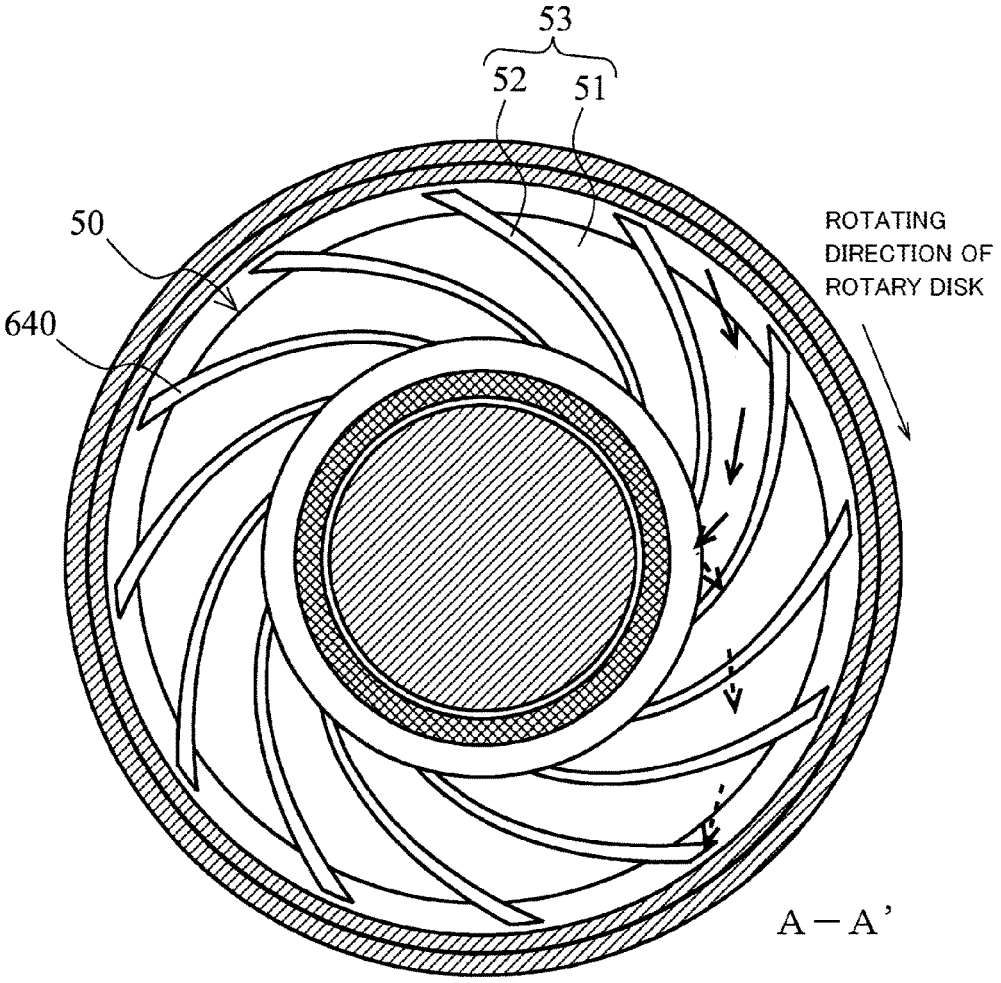
FIG. 28 is a view for illustrating the stationary disk according to each of the embodiments of the present invention.

FIG. 28 is a view for illustrating the modification of each of the embodiments described above, which is a cross-sectional view in which the stationary disk 50 is viewed from the inlet port 4 in the A-A' direction in each of the drawings showing the example of the schematic configuration.

As shown in FIG. 28, each of the protruding portions (projecting portions) according to each of the embodiments of the present invention may also be configured of a projecting portion 640 formed of an end portion of the stationary-disk ridge portion 52 that has been extended in an outer-diameter-side extending direction.

The projecting portions 640 are different from the projecting portions in each of the embodiments described above in that there is no bent portion at the boundaries between the projecting portions 640 and the stationary-disk ridge portions 52 engraved in the stationary disk 50 and the projecting portions 640 have shapes formed of curves extended from the curves forming the stationary-disk ridge portions 52.

(ii-10) Modification of Each of Embodiments

Figure 29:
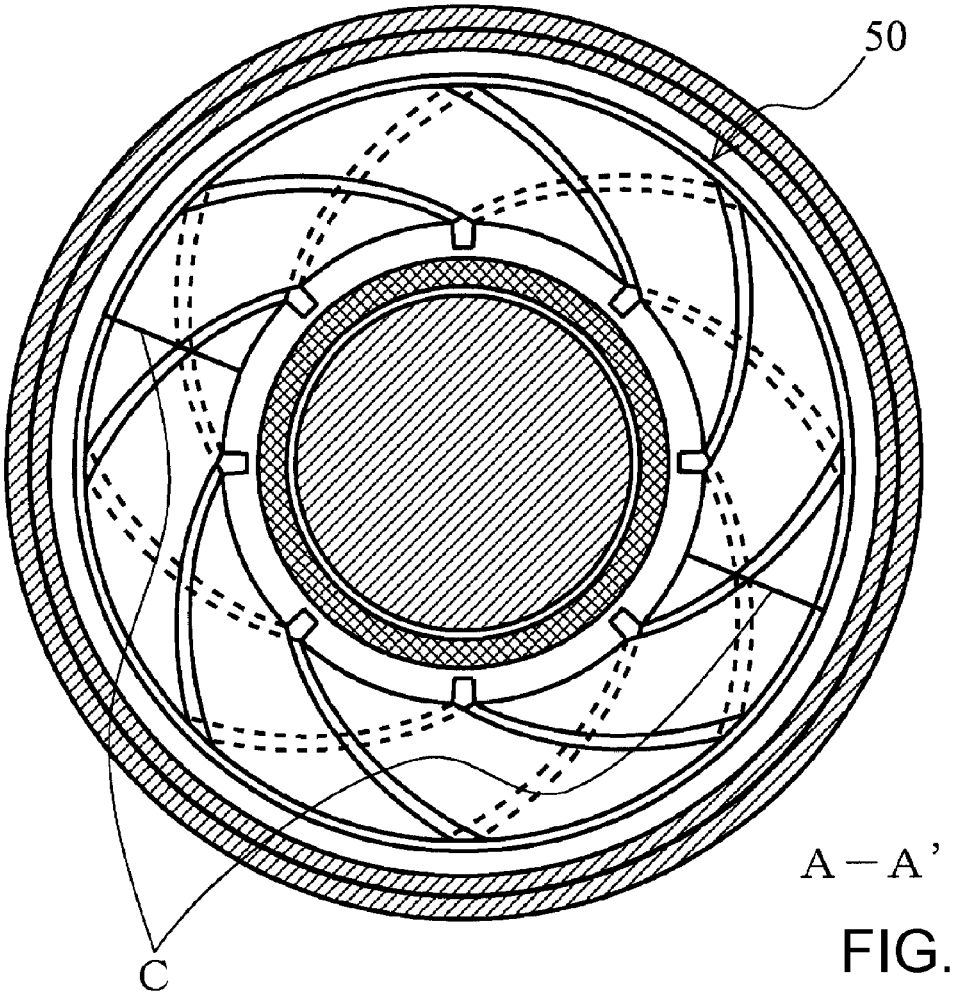
FIG. 29 is a view for illustrating the stationary disk according to each of the embodiments of the present invention.
Figure 30:
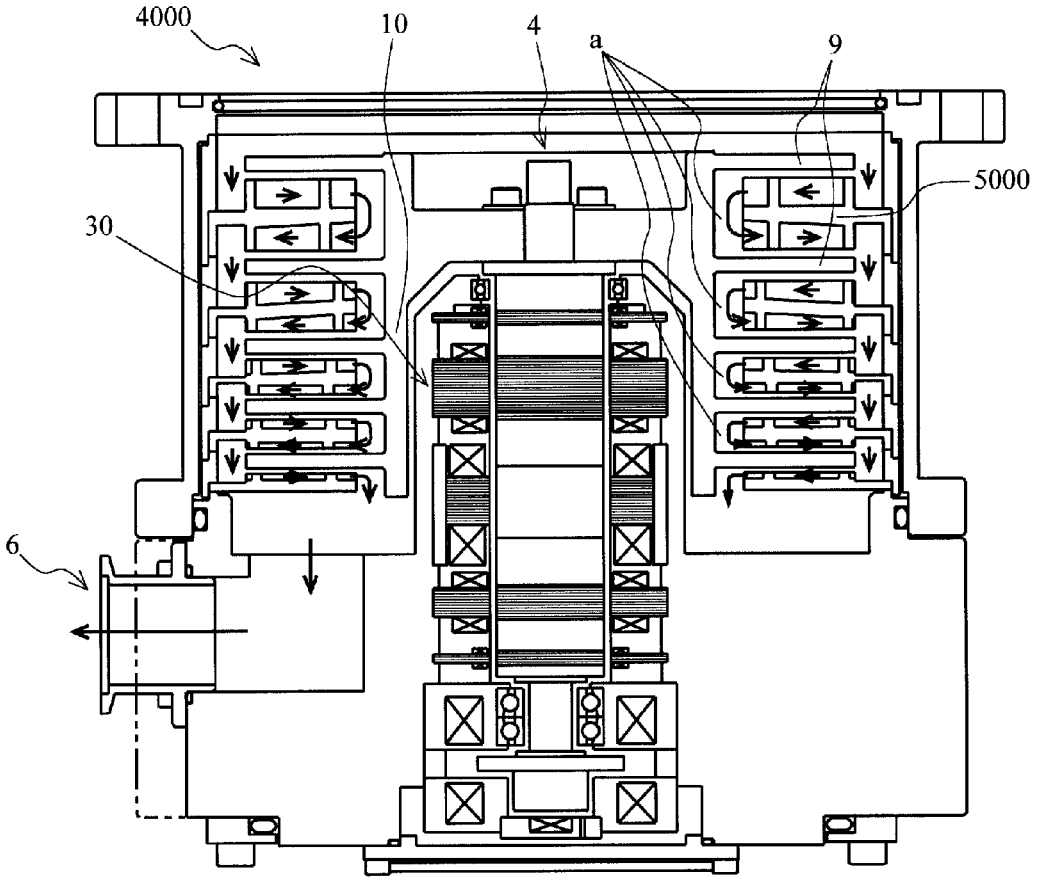
FIG. 30 is a view for illustrating a related-art technique, which shows an example of a schematic configuration of a Siegbahn type molecular pump.
Figure 31:
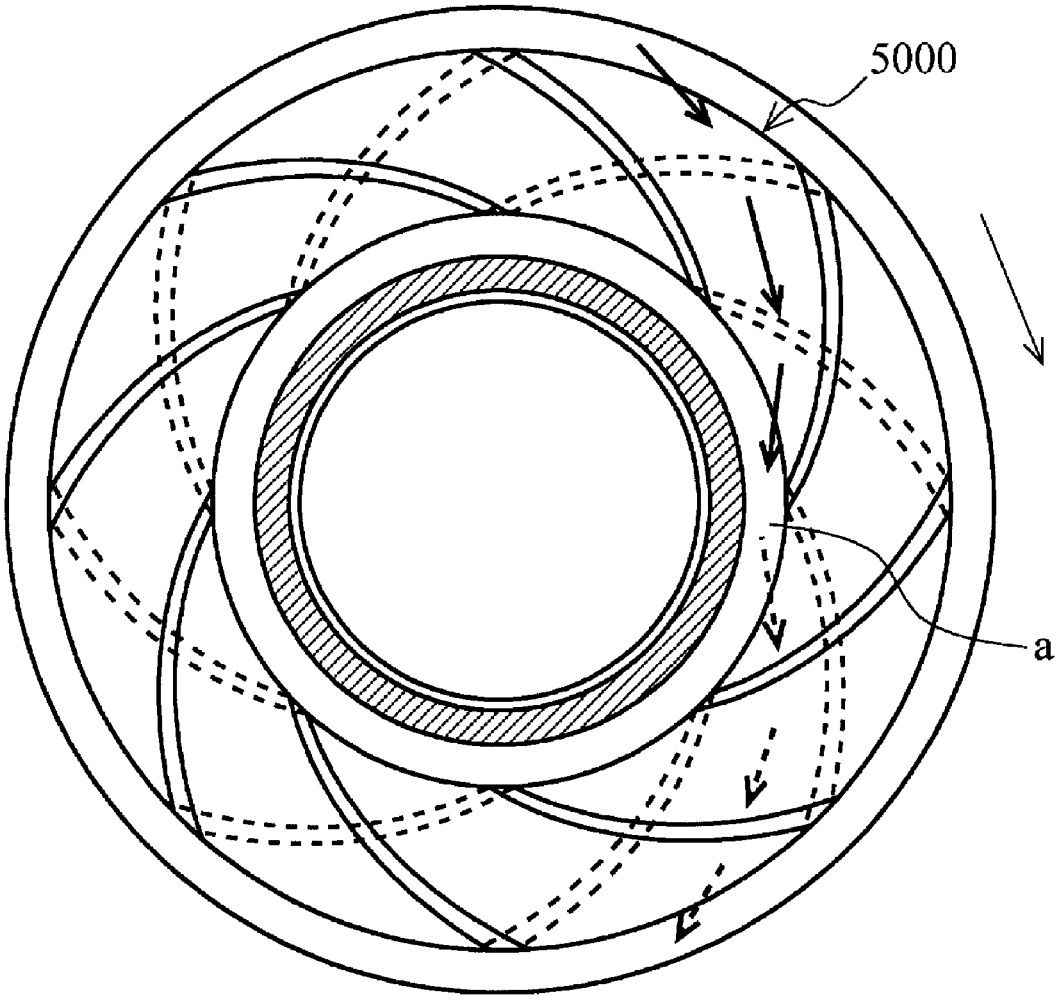
FIG. 31 is a cross-sectional view for illustrating the related-art technique, which is a cross-sectional view of each of stationary disks when viewed from an inlet port.

FIG. 29 is a view for illustrating a modification of the stationary disk according to each of the embodiments of the present invention, which is a cross-sectional view when the stationary disk 50 is viewed from the inlet port 4 in the A-A' direction in each of the drawings showing the example of the schematic configuration.

As shown in FIG. 29, the stationary disk 50 may also be configured to be formed of a plurality of components.

In FIG. 29, by way of example, the stationary disk 50 is configured to include two semi-circular components to be able to be divided at a division surface C.

The predetermined angle (depression angle) described in each of the embodiments and the modifications is preferably configured of an angle of 5 to 85 degrees.

Note that the individual embodiments may also be combined with each other.

Also, each of the embodiments of the present invention described above is not limited to the Siegbahn type molecular pump. Each of the embodiments of the present invention is also applicable to a compound pump including a Siegbahn type molecular pump portion and a turbo molecular pump portion, a compound pump including a Siegbahn type molecular pump portion and a thread groove type pump portion, or a compound pump including a Siegbahn type molecular pump portion, a turbo molecular pump portion, and a thread groove type pump portion.

In the compound vacuum pump including the turbo molecular pump portion, a rotary portion including a rotary shaft and a rotor fixed to the rotary shaft is further included and, on the rotor, rotor vanes (dynamic vanes) provided radially are disposed in multiple stages, though not shown. In addition, a stationary portion in which stator vanes (static vanes) are disposed in multiple stages to alternate with the rotor vanes are also included.

In the compound vacuum pump including the thread groove type pump portion, a thread groove spacer having helical grooves (spiral grooves) formed in a surface thereof facing a rotary cylinder and facing an outer peripheral surface of the rotary cylinder with a predetermined clearance held therebetween is further included, though not shown. A gas transport mechanism is also included in which, when the rotary cylinder rotates at a high speed, gas molecules are sent toward an outlet port with the rotation of the rotary cylinder, while being guided by thread grooves.

The compound turbo molecular pump including the turbo molecular pump portion and the thread groove type pump portion is configured such that the turbo molecular pump portion described above and the thread groove type pump portion described above are further included and a gas transport mechanism is included in which gas is compressed by the turbo molecular pump portion (first gas transport mechanism) and then further compressed in the thread groove type pump portion (second gas transport mechanism), though not shown.

Due to this configuration, each of the Siegbahn type molecular pumps according to the embodiments of the present invention can achieve the following effects.

(1) Since losses in a bent region closer to the rotary cylinder and a bent region closer to the spacer can be minimized, it is possible to construct a Siegbahn type molecular pump in which a loss in the bent flow path is minimized.

(2) Since both or one of a region formed by the rotary cylinder and the stationary disk and a region formed by the spacer and the stationary disk that have conventionally been flow paths having no exhausting function can be used as an exhaust space, a space efficiency is high. Therefore, it is possible to achieve reductions in the sizes of the rotor, the pump, and the bearing which supports the rotor as well as improved energy saving due to the improved efficiency.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump component, comprising:

a disk-shaped portion having spiral grooves disposed in an inlet port side and an outlet port side, wherein a projection is disposed on at least a part of at least any one of an inner peripheral side surface or an outer peripheral side surface of the disk-shaped portion in which the spiral groove is not disposed, an outer peripheral side surface of a cylinder-shaped portion which is disposed on an inner peripheral side of the disk-shaped portion and which is concentric to the disk-shaped portion, and an inner peripheral side surface of a cylinder-shaped portion which is disposed on an outer peripheral side of the disk-shaped portion and which is concentric to the disk-shaped portion, and an exit of a first spiral groove on the inlet port side has a portion axially overlapping with an entrance of a second spiral groove on the outlet port side.

2. The vacuum pump component according to claim 1, wherein the disposition number of the projection is an integral multiple of the disposition number of the spiral groove.

3. The vacuum pump component according to claim 1, wherein the disposition number of the spiral groove is an integral multiple of the disposition number of the projection.

4. The vacuum pump component according to claim 1, wherein, at a surface where the projection is disposed, a position of the projection corresponds to a position of an end portion, on a side of the surface, of a ridge portion of the spiral groove.

5. The vacuum pump component according to claim 1, wherein, at a surface where the projection is disposed, the projection and an end portion, on a side of the surface, of a ridge portion of the spiral groove are disposed in a continuous shape.

6. The vacuum pump component according to claim 1, wherein the projection is disposed at a predetermined angle relative to a center axis of the disk-shaped portion.

7. The vacuum pump component according to claim 1, wherein the projection is disposed to have a size such that an amount of projection thereof is not less than 70% of a depth of the spiral groove at a portion thereof which is close to the projection.

8. The vacuum pump component according to claim 1, wherein the disk-shaped portion includes one or a plurality of components.

9. A Siegbahn type exhaust mechanism, comprising:

the vacuum pump component according to claim 1; and a second component having a surface facing the spiral groove, wherein a gas is transported by an interaction of the vacuum pump component and the second component.

10. The Siegbahn type exhaust mechanism according to claim 9, wherein the second component and the projection are disposed to have sizes such that a distance between respective surfaces of the second component and the projection which face each other is not more than 2-mm.

11. The Siegbahn type exhaust mechanism according to claim 9, wherein the projection is disposed to be inclined in a direction of exhaust in a vacuum pump including the vacuum pump component.

12. A compound vacuum pump, comprising in a compounded form:

the Siegbahn type exhaust mechanism according to claim 9; and a thread groove type molecular pump mechanism.

13. A compound vacuum pump, comprising in a compounded form:

the Siegbahn type exhaust mechanism according to claim 9; and a turbo molecular pump mechanism.

14. A compound vacuum pump, comprising in a compounded form:

the Siegbahn type exhaust mechanism according to claim 9;

a thread groove type molecular pump mechanism; and a turbo molecular pump mechanism.

15. A vacuum pump component, comprising:

a cylinder-shaped portion disposed concentrically with a disk-shaped portion having a spiral grooves disposed in an inlet port side and an outlet port side, wherein a projection is disposed on at least a part of at least any one of an outer peripheral side surface of the cylinder-shaped portion when the disk-shaped portion is disposed on an outer peripheral side of the cylinder-shaped portion and an inner peripheral side surface of the cylinder-shaped portion when the disk-shaped portion is disposed on an inner peripheral side of the cylinder-shaped portion, and an exit of a first spiral groove on the inlet port side has a portion axially overlapping with an entrance of a second spiral groove on the outlet port side.

* * * * *